US008348692B2

(12) United States Patent
Montena

(10) Patent No.: US 8,348,692 B2
(45) Date of Patent: Jan. 8, 2013

(54) SECURABLE MULTI-CONDUCTOR CABLE CONNECTION PAIR HAVING THREADED INSERT

(75) Inventor: Noah Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/955,978

(22) Filed: Nov. 30, 2010

(65) Prior Publication Data

US 2012/0135629 A1 May 31, 2012

(51) Int. Cl.
*H01R 13/627* (2006.01)

(52) U.S. Cl. ..... 439/359

(58) Field of Classification Search ..... 439/358, 439/327, 326, 353, 357, 350, 939, 138, 680
See application file for complete search history.

(56) References Cited

U.S. PATENT DOCUMENTS

| | | | |
|---|---|---|---|
| 2,238,834 | A | 4/1941 | Travers |
| 2,449,983 | A | 9/1948 | Devol |
| 2,761,110 | A | 8/1956 | Edlen et al. |
| 3,184,706 | A | 5/1965 | Atkins |
| 3,336,563 | A | 8/1967 | Hyslop |
| 3,683,320 | A | 8/1972 | Woods et al. |
| 3,706,958 | A | 12/1972 | Blanchenot |
| 4,261,632 | A | 4/1981 | Narozny |
| 4,352,240 | A | 10/1982 | Komada |
| 4,374,458 | A | 2/1983 | Komada |
| 4,553,806 | A | 11/1985 | Forney, Jr. et al. |
| 4,557,546 | A | 12/1985 | Dreyer |
| 4,688,877 | A | 8/1987 | Dreyer |
| 4,789,355 | A | 12/1988 | Lee |
| 4,799,902 | A | 1/1989 | Laudig et al. |
| 5,066,248 | A | 11/1991 | Gaver, Jr. et al. |
| 5,073,129 | A | 12/1991 | Szegda |
| 5,154,637 | A | 10/1992 | Klug et al. |
| 5,261,839 | A | 11/1993 | Franks, Jr. |
| 5,318,458 | A | 6/1994 | Thorner |
| 5,362,251 | A | 11/1994 | Bielak |
| 5,470,257 | A | 11/1995 | Szegda |
| 5,527,190 | A | 6/1996 | Weingartner |

(Continued)

FOREIGN PATENT DOCUMENTS

DE 4229812 C1 3/1994

OTHER PUBLICATIONS

U.S. Appl. No. 12/946,157, filed Nov. 15, 2010.

(Continued)

*Primary Examiner* — Tulsidas C Patel
*Assistant Examiner* — Phuongchi Nguyen
(74) *Attorney, Agent, or Firm* — Schmeiser, Olsen & Watts, LLP

(57) ABSTRACT

A multi-conductor cable connector comprising a connector engagement portion including: a rotatable outer housing, a threaded insert radially disposed within the outer housing, wherein the threaded insert has a slot therethrough, a key feature integral with the rotatable outer housing, the key feature configured to fit within the slot of the threaded insert, and a plurality of electrical contacts, wherein rotational movement of the rotatable housing is translated to axial movement of the threaded insert to securably engage a matingly corresponding multi-conductor cable connector. A multi-conductor cable connection pair is also provided. Furthermore, an associated method is also provided.

14 Claims, 12 Drawing Sheets

U.S. PATENT DOCUMENTS 5,890,925 A 4/1999 Bernardini
5,997,350 A 12/1999 Burris et al.
6,109,963 A 8/2000 Follingstad et al.
6,116,945 A 9/2000 Davis et al.
6,123,567 A 9/2000 McCarthy
6,149,469 A 11/2000 Kim
6,153,830 A 11/2000 Montena
6,179,656 B1 1/2001 Wong
6,210,222 B1 4/2001 Langham et al.
6,254,430 B1 7/2001 Endo et al.
6,261,126 B1 7/2001 Stirling
6,331,123 B1 12/2001 Rodrigues
6,517,379 B2 2/2003 Leve
6,558,194 B2 5/2003 Montena
6,568,964 B2 5/2003 D'Addario
6,575,784 B1 6/2003 Yamada
6,644,993 B2 11/2003 Victor
6,676,446 B2 1/2004 Montena
6,705,884 B1 3/2004 McCarthy
6,722,902 B2 4/2004 Kedzierski
6,729,912 B2 5/2004 D'Addario
6,749,454 B2 * 6/2004 Schmidt et al. ..... 439/350
6,764,350 B2 7/2004 Kosmala
6,786,774 B2 9/2004 Haas, II et al.
6,848,940 B2 2/2005 Montena
6,860,760 B2 3/2005 Endo et al.
6,884,113 B1 4/2005 Montena
6,966,796 B2 11/2005 Abe et al.
7,029,326 B2 4/2006 Montena
7,048,579 B2 5/2006 Montena
7,094,103 B2 8/2006 Lai
7,121,872 B1 10/2006 Hanks
7,153,159 B2 12/2006 Burris et al.
7,156,695 B2 1/2007 Holliday
D542,225 S 5/2007 Victor
7,217,155 B2 5/2007 Montena
7,226,320 B2 6/2007 Abe et al.
7,311,554 B1 12/2007 Jackson et al.
7,458,849 B2 12/2008 Rodrigues et al.
7,458,851 B2 12/2008 Montena
7,476,119 B2 1/2009 D'Addario et al.
7,488,187 B2 2/2009 Wolf
7,841,898 B1 11/2010 Titus
7,857,643 B2 12/2010 Dobler
7,997,929 B2 8/2011 Montena
8,016,615 B2 9/2011 Montena
2003/0207620 A1 11/2003 Haas, II et al.
2003/0224658 A1 12/2003 Koch et al.
2005/0085125 A1 4/2005 Montena
2005/0164553 A1 7/2005 Montena
2006/0014425 A1 1/2006 Montena
2006/0063426 A1 3/2006 Khemakhem et al.
2006/0194474 A1 8/2006 Montena
2008/0045082 A1 2/2008 Kuo
2008/0261445 A1 10/2008 Malloy et al.
2009/0186503 A1 7/2009 Dobler
2009/0233482 A1 9/2009 Chawgo et al.
2010/0144183 A1 * 6/2010 Nania et al. ..... 439/248
2010/0203760 A1 8/2010 Montena
2010/0261381 A1 10/2010 Montena et al.
2011/0039449 A1 2/2011 Montena
2011/0059648 A1 3/2011 Montena
2011/0059649 A1 3/2011 Montena
2011/0237110 A1 9/2011 Montena
2011/0300747 A1 12/2011 Montena
2011/0306226 A1 12/2011 Montena
2011/0306247 A1 12/2011 Montena
2012/0003870 A1 1/2012 Montena
2012/0094521 A1 4/2012 Montena

OTHER PUBLICATIONS

U.S. Appl. No. 13/152,431, filed Jun. 3, 2011.
PCT/US2011/039289. International Search Report / Written Opinion. Date of Mailing Feb. 28, 2012. 10 Pages.
Office Action (Mail Date: Jul. 5, 2012) for U.S. Appl. No. 12/946,157, filed Nov. 15, 2010.

* cited by examiner

SECURABLE MULTI-CONDUCTOR CABLE CONNECTION PAIR HAVING THREADED INSERT

FIELD OF TECHNOLOGY

The present invention relates to a multi-conductor cable connection pair, and more specifically to embodiments of a multi-conductor cable connection pair having a moveable threadable engagement insert.

BACKGROUND

Multi-conductor cables, such as those used for microphone and lighting application, are often held together when mated, male to female, by a combination of the friction in the electrical contacts, and a latching mechanism. Due to a variety of latch designs on male and female multi-conductor cables from different manufactures, the latching mechanisms do not always securely latch with one another. Moreover, when the latching mechanism does latch securely, it is common for the latching mechanism to be inadvertently disengaged. For example, the multi-conductor cable connectors may become disengaged while a performer taps a microphone against another instrument or against his or her hand while performing, or a technician dropping the junction to the floor after joining the two multi-conductor cables chest height.

Thus, a need exists for an apparatus and method for a connection that secures the male and female multi-conductor cable connectors without unwanted disengagement, but is also backward compatible with standard multi-conductor cables.

SUMMARY

A first general aspect relates to a multi-conductor cable connector comprising a connector engagement portion including: a rotatable outer housing, a threaded insert radially disposed within the outer housing, wherein the threaded insert has a slot therethrough, a key feature integral with the rotatable outer housing, the key feature configured to fit within the slot of the threaded insert, and a plurality of electrical contacts; wherein the rotational movement of the rotatable housing is translated to axial movement of the threaded insert to securably engage a matingly corresponding multi-conductor cable connector.

A second general aspect relates to a multi-conductor cable connection pair comprising a first multi-conductor cable connector having a first cable connection portion coupled to a first connector engagement portion, wherein the first cable engagement portion includes a rotatable outer housing and a threaded insert disposed within the rotatable outer housing, and a second multi-conductor cable connector having a second cable connection portion coupled to a second connector engagement portion, wherein the second connector engagement portion includes a threaded outer housing configured to engage the threaded insert of the first connector engagement portion, wherein the engagement of the threaded insert and the threaded outer housing securably join the first multi-conductor cable connector and the second multi-conductor cable connector.

A third general aspect relates to a multi-conductor cable connector comprising a connector engagement portion including: an outer housing having a first end a second end, wherein the outer housing includes external threads proximate the second end, a securing means including a latch arm and a latch head attached to an end of the latch arm, the securing means being releasable with a lock button, a plurality of electrical contacts; wherein the external threads of the outer housing are configured to mate with threads of a threaded insert disposed within a corresponding multi-conductor cable connector to securably engage the corresponding multi-conductor cable connector after achieving a fully mated position upon full axial insertion into the corresponding multi-conductor cable connector.

A fourth general aspect relates to a multi-conductor cable connection pair comprising a first multi-conductor cable connector having a first cable connection portion coupled to a first connector engagement portion, a second multi-conductor cable connector having a second cable connection portion coupled to a second connector engagement portion, and means for threadably securing the first multi-conductor cable connector to the second multi-conductor cable connector.

A fifth general aspect relates to a method of securing a multi-conductor cable connector to a corresponding multi-conductor cable connector, comprising providing a connector engagement portion including: a rotatable outer housing, a threaded insert radially disposed within the outer housing, and a plurality of electrical contacts; and wherein rotating the outer housing axially advances the threaded insert to securably engage the corresponding multi-conductor cable connector.

A sixth general aspect relates to a method of securing a multi-conductor cable connection pair, the method comprising providing a first multi-conductor cable connector having a first cable connection portion coupled to a first connector engagement portion, wherein the first cable engagement portion includes a rotatable outer housing and a threaded insert disposed within the rotatable outer housing, and a second multi-conductor cable connector having a second cable connection portion coupled to a second connector engagement portion, wherein the second connector engagement portion includes a threaded outer housing configured to engage the threaded insert of the first connector engagement portion; and advancing the threaded insert onto the threaded outer housing through rotational movement of the rotatable outer housing.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1A:
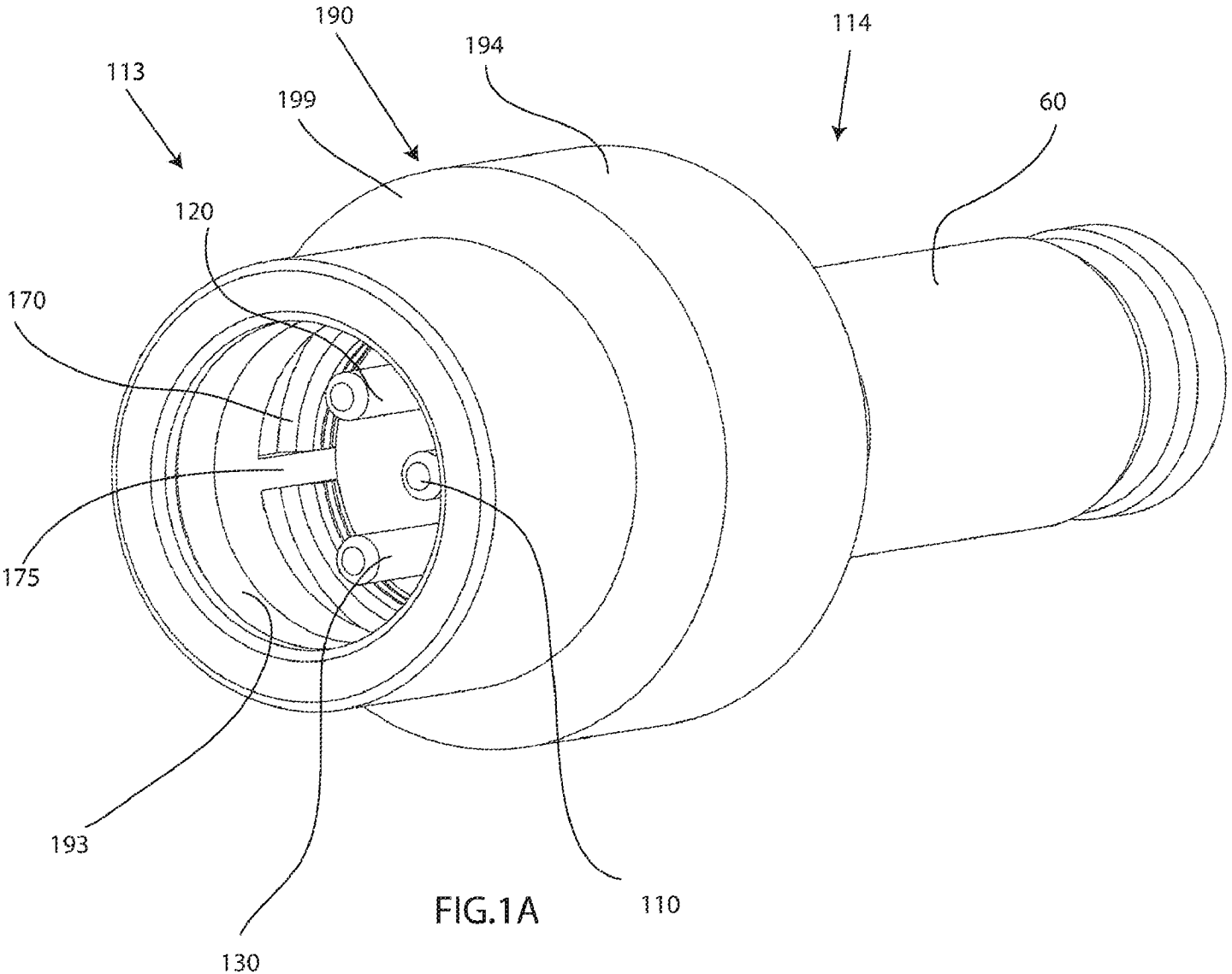
FIG. 1A depicts a perspective view of an embodiment of a male type multi-conductor cable connector.
Figure 1B:
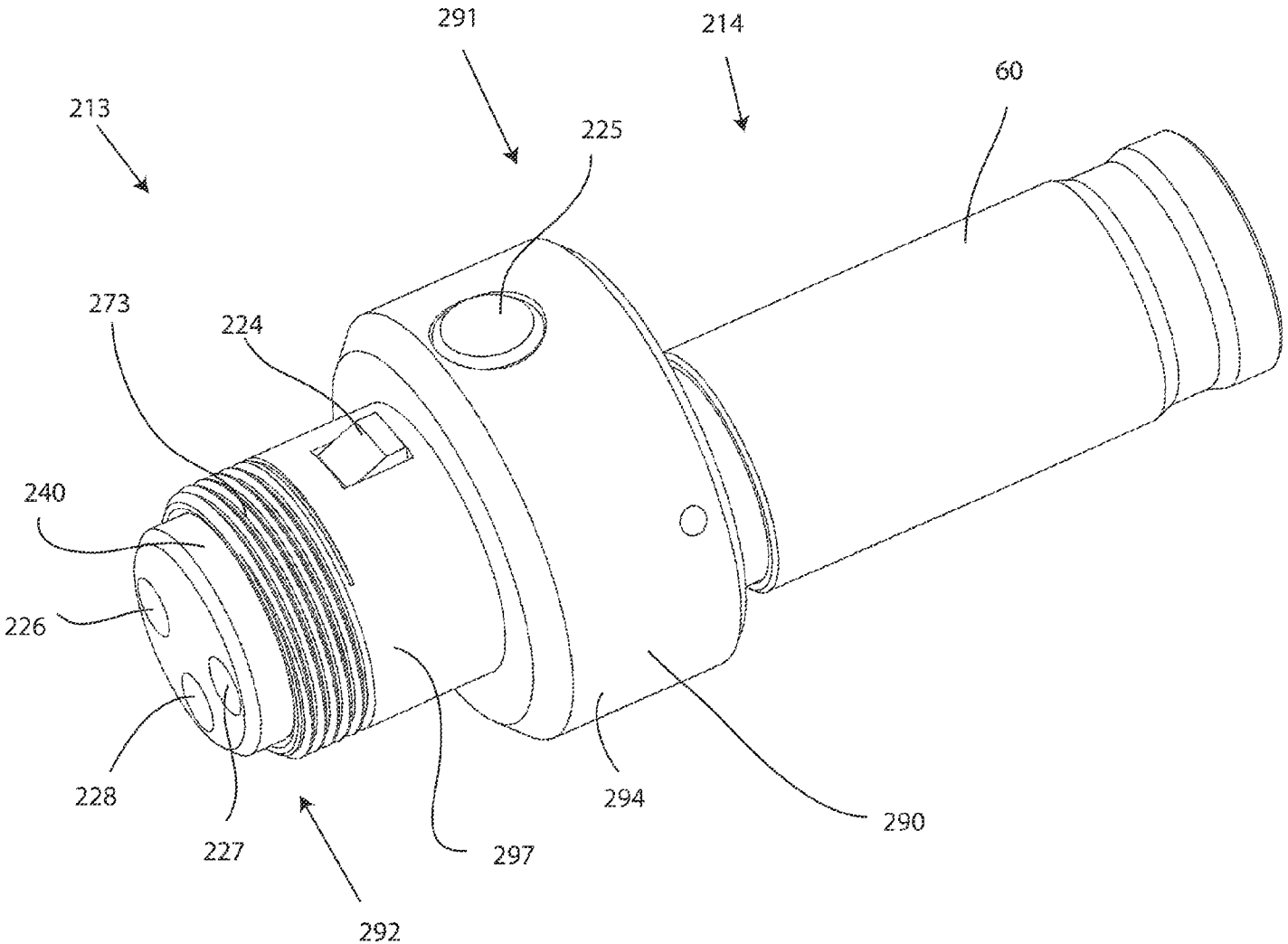
FIG. 1B depicts a perspective view of an embodiment of a female type multi-conductor cable connector.

Referring to the drawings, FIG. 1A depicts an embodiment of a male multi-conductor cable 100 including embodiments of a connector engagement portion 113 and a cable connection portion 114. The multi-conductor cable connector embodiment 100 may be a male XLR type connector, multi-conductor cable connector, triaxial cable connector, and the like. FIG. 1B depicts an embodiment of a multi-conductor cable 200 having embodiments of a connector engagement portion 213 and a cable connection portion 214. The multi-conductor cable connector embodiment 200 may be a female XLR-type connector, multi-conductor cable connector, tri-axial cable connector, and the like. The mating of male multi-conductor cable connector 100 and female multi-conductor cable connector may be a multi-conductor cable connection pair 5. Thus, the cable connection 5 can include a connector 100 and a connector 200, typically a male and a female type multi-conductor cable connector. The multi-conductor cable connection pair 5 may be securably joined together. In addition, the multi-conductor cable connection pair 5 may be securably threadably engaged to prevent unwanted disengagement while also establishing and maintaining multiple continuous electrical paths through the connection pair 5, including each connector 100, 200. As further depicted in FIGS. 1A and 1B, connector 100, 200 may include a connector engagement portion 113, 213 coupled to the cable connection portion 114. In one embodiment of a multi-conductor cable connector 100, 200 the connector engagement portion 113, 213 may be coupled to the cable connection portion 114, 214 in coaxial union (e.g. connected at an angle of 0° or 180°) with the cable connection portion 114, 214. In another embodiment, the connector engagement portion 113, 214 may be coupled to the cable connection portion 114, 214 by the use of an additional structural element. In still another embodiment, the connector engagement portion 113, 213 may be partially coupled coaxially to the cable connection portion 114, 214. In still yet another embodiment, the connector engagement portion 113, 213 may be connected to the cable connection portion 114, 214 at an angle other than 0° or 180°.

A multi-conductor cable connector embodiment 100, 200 has a first end 1 and a second end 2, and can be provided to a user in a preassembled configuration to ease handling and installation during use. Multi-conductor cable connector 100, 200 may be a XLR connector, XLR3 connector, any XLR-type connector, tri-axial cable connector, 3-contact connector, and the like. In one embodiment, the connector 100, 200 may also have a cable connection portion 114, 214, respectively.

Embodiments of a multi-conductor cable connector 100, 200 include a plurality of electrical contacts 110, 120, 130 and 210, 220, 230 configured to engage with the cable connection portion 114, 214.

In one embodiment, a multi-conductor cable connection pair 5 may include a first multi-conductor cable connector 100 having a first cable connection portion 114 coupled to a first connector engagement portion 113, wherein the first cable engagement portion 113 includes a rotatable outer housing 190 and a threaded insert 170 disposed within the rotatable outer housing 190, and a second multi-conductor cable connector 200 having a second cable connection portion 214 coupled to a second connector engagement portion 213, wherein the second connector engagement portion 213 includes a threaded outer housing 290 configured to engage the threaded insert 170 of the first connector engagement portion 113, wherein the engagement of the threaded insert 170 and the threaded outer housing 290 securably join the first multi-conductor cable connector 100 and the second multi-conductor cable connector 200. In another embodiment, a multi-conductor cable connector 100 may include a connector engagement portion 113 including: a rotatable outer housing 190, a threaded insert 170 radially disposed within the outer housing 190, wherein the threaded insert 170 has a slot 175 therethrough, a key feature 150 integral with the rotatable outer housing 190, the key feature 150 configured to fit within the slot 175 of the threaded insert 170, and a plurality of electrical contacts 110, 120, 130; wherein the rotational movement of the rotatable housing 190 is translated to axial movement of the threaded insert 170 to securably engage a matingly corresponding multi-conductor cable connector 200. In yet another embodiment, a multi-conductor cable 200 may include a connector engagement portion 213 including: an outer housing 290 having a first end 291*a* second end 292, wherein the outer housing 290 includes external threads 273 proximate the second end 292, a securing means 221 including a latch arm 223 and a latch head 224 attached to an end of the latch arm 223, the securing means 221 being releasable with a lock button 225, a plurality of electrical contacts 210, 220, 230; wherein the external threads 273 of the outer housing 290 are configured to mate with threads 173 of a threaded insert 170 disposed within a corresponding multi-conductor cable connector 100 to securably engage the corresponding multi-conductor cable connector 100 after achieving a fully mated position upon full axial insertion into the corresponding multi-conductor cable connector 100.

Figure 2:
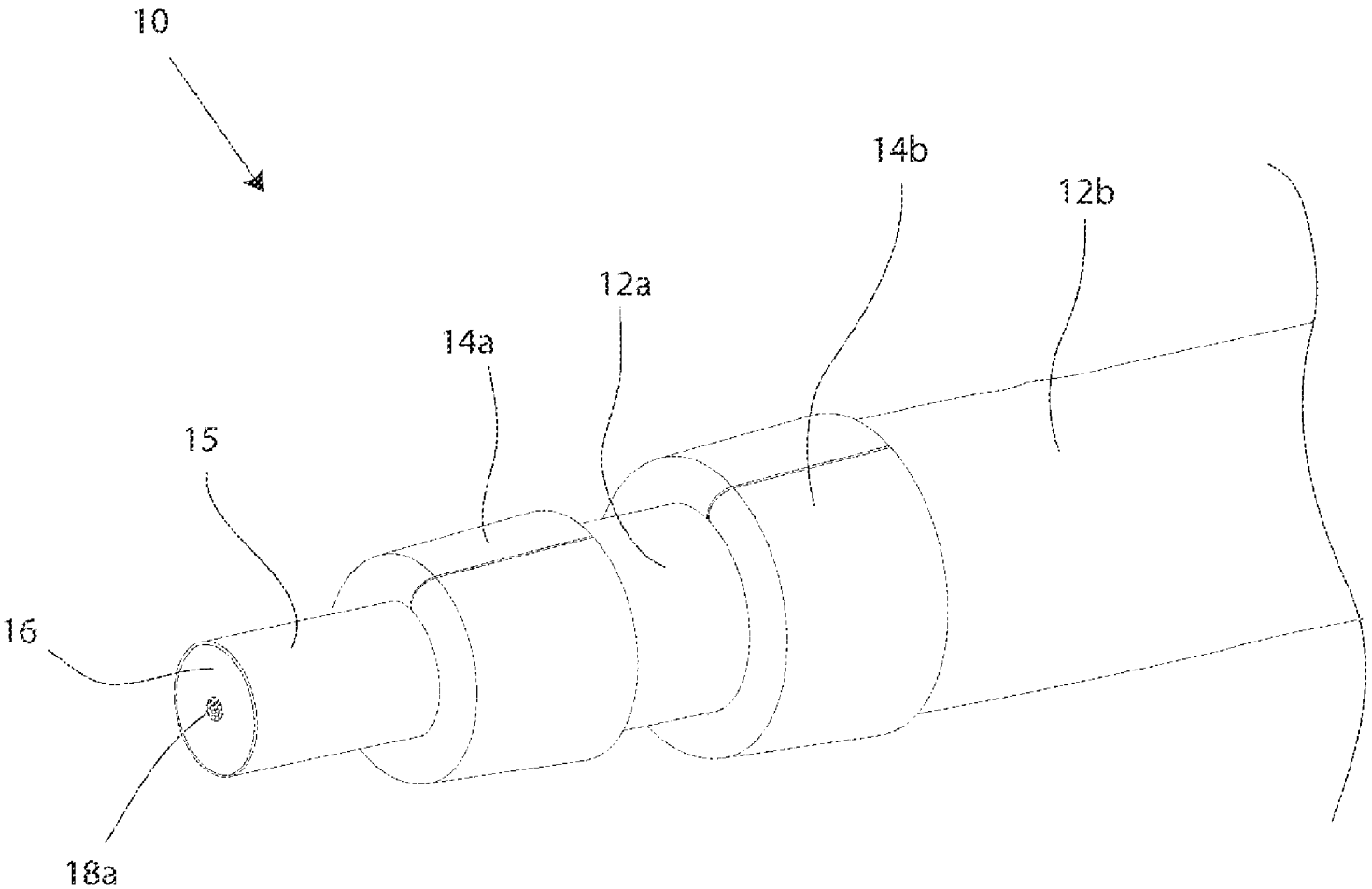
FIG. 2 depicts a perspective view of a first embodiment of a multi-conductor cable having a plurality of conductive strands concentrically sharing a common central axis.

Referring now to FIG. 2, the cable connection portion 114, 214 of a multi-conductor cable connector 100, 200 may be operably affixed to a prepared end of a multi-conductor cable 10 so that the cable 10 is securely attached to the cable connection portion 114, 214. The multi-conductor cable 10 may include a center conductive strand 18*a*, surrounded by an interior dielectric 16; the interior dielectric 16 may possibly be surrounded by a conductive foil layer 15; the interior dielectric (and the possible conductive foil layer 15) is surrounded by a first conductive strand layer 14*a*; the first conductive strand layer 14*a* is surrounded by a first protective outer jacket 12*a*, wherein the first protective outer jacket 12*a* is has dielectric properties and serves as an insulator; the first protective outer jacket 12*a* is surrounded by a second conductive strand layer 14*b*; and, the second conductive strand layer 14*b* is surrounded by a second protective outer jacket 12*b*. The second conductive strand layer 14*b* may be the radially outermost conductive strand layer of the cable 10. The second conductive strand layer 14*b* may extend a grounding path providing an electromagnetic shield about the inner conductive strands 14*a* and 18 of the multi-conductor cable 10. The multi-conductor cable 10 may be prepared by removing the first protective outer jacket 12*a* and drawing back the first conductive strand layer 14*a* to expose a portion of the interior dielectric 16 (and possibly the conductive foil layer 15 that may tightly surround the interior dielectric 16) and center conductive strand 18*a*. Additionally, the preparation of the cable 10 may include removing the second protective outer jacket 12*b* and drawing back the second conductive grounding shield 14*b* a distance to expose a portion of the first protective outer jacket 12*a*. The protective outer jackets 12*a*, 12*b* can physically protect the various components of the multi-conductor cable 10 from damage which may result from exposure to dirt or moisture, and from corrosion. Moreover, the protective outer jackets 12*a*, 12*b* may serve in some measure to secure the various components of the multi-conductor cable 10 in a contained cable design that protects the cable 10 from damage related to movement during cable installation. The conductive strand layers 14*a*, 14*b* can be comprised of conductive materials suitable for carrying electromagnetic signals and/or providing an electrical ground connection or electrical path connection. The conductive strand layers 14*a*, 14*b* may also be conductive layers, braided layers, and the like. Various embodiments of the conductive strand layers 14*a*, 14*b* may be employed to screen unwanted noise. For instance, the first conductive strand layer 14*a* may comprise a metal foil (in addition to the possible conductive foil 15) wrapped around the dielectric 16 and/or several conductive strands formed in a continuous braid around the dielectric 16. Furthermore, the second conductive strand layer 14*b* may also include a metal foil (in addition to the possible conductive foil 15) wrapped around the first protective outer jacket 12*a* and/or several conductive strands formed in a continuous braid around the first protective outer jacket 12*a*. Combinations of foil and/or braided strands may be utilized wherein the conductive strand layers 14*a*, 14*b* may comprise a foil layer, then a braided layer, and then a foil layer. Those in the art will appreciate that various layer combinations may be implemented in order for the conductive strand layers 14*a*, 14*b* to effectuate an electromagnetic buffer helping to prevent ingress of environmental noise or unwanted noise that may disrupt broadband communications. In most embodiments, there may be more than one conductive strand layer, such as a triaxial, tri-shield, or quad shield cable, etc., and there may also be flooding compounds protecting the conductive strand layers 14*a*, 14*b*. The dielectric 16 may be comprised of materials suitable for electrical insulation. The first protective outer jacket 12*a* may also be comprised of materials suitable for electrical insulation. It should be noted that the various materials of which all the various components of the multi-conductor cable 10 are comprised should have some degree of elasticity allowing the cable 10 to flex or bend in accordance with traditional broadband communications standards, installation methods and/or equipment. It should further be recognized that the radial thickness of the multi-conductor cable 10, protective outer jackets 12*a*, 12*b*, conductive strand layers 14*a*, 14*b*, possible conductive foil layer 15, interior dielectric 16 and/or center conductive strand 18*a* may vary based upon generally recognized parameters corresponding to broadband communication standards and/or equipment.

Figure 3A:
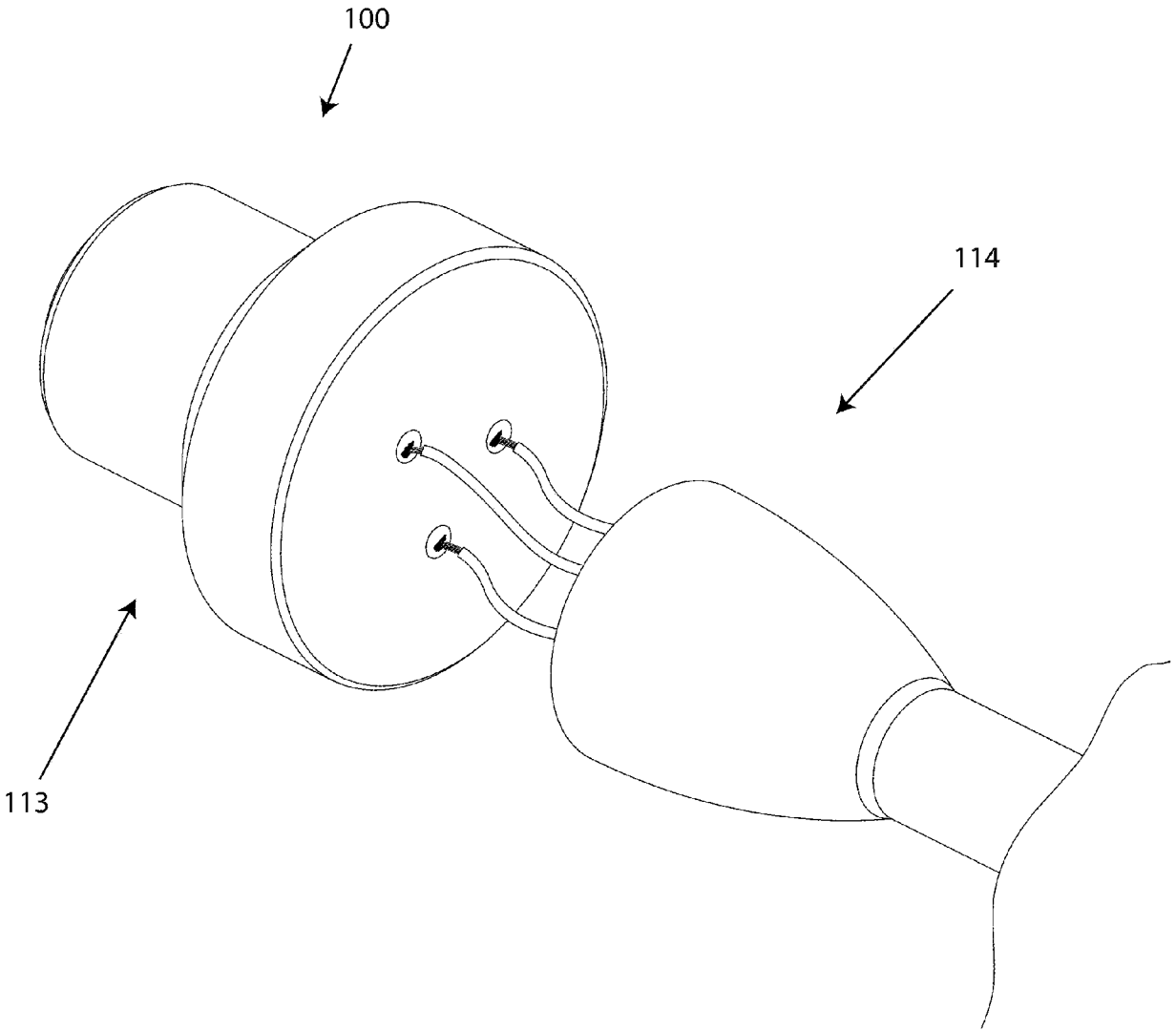
FIG. 3A depicts a schematic view of the first embodiment of a multi-conductor cable connector, wherein a cable connection portion is a soldered connection.
Figure 3B:
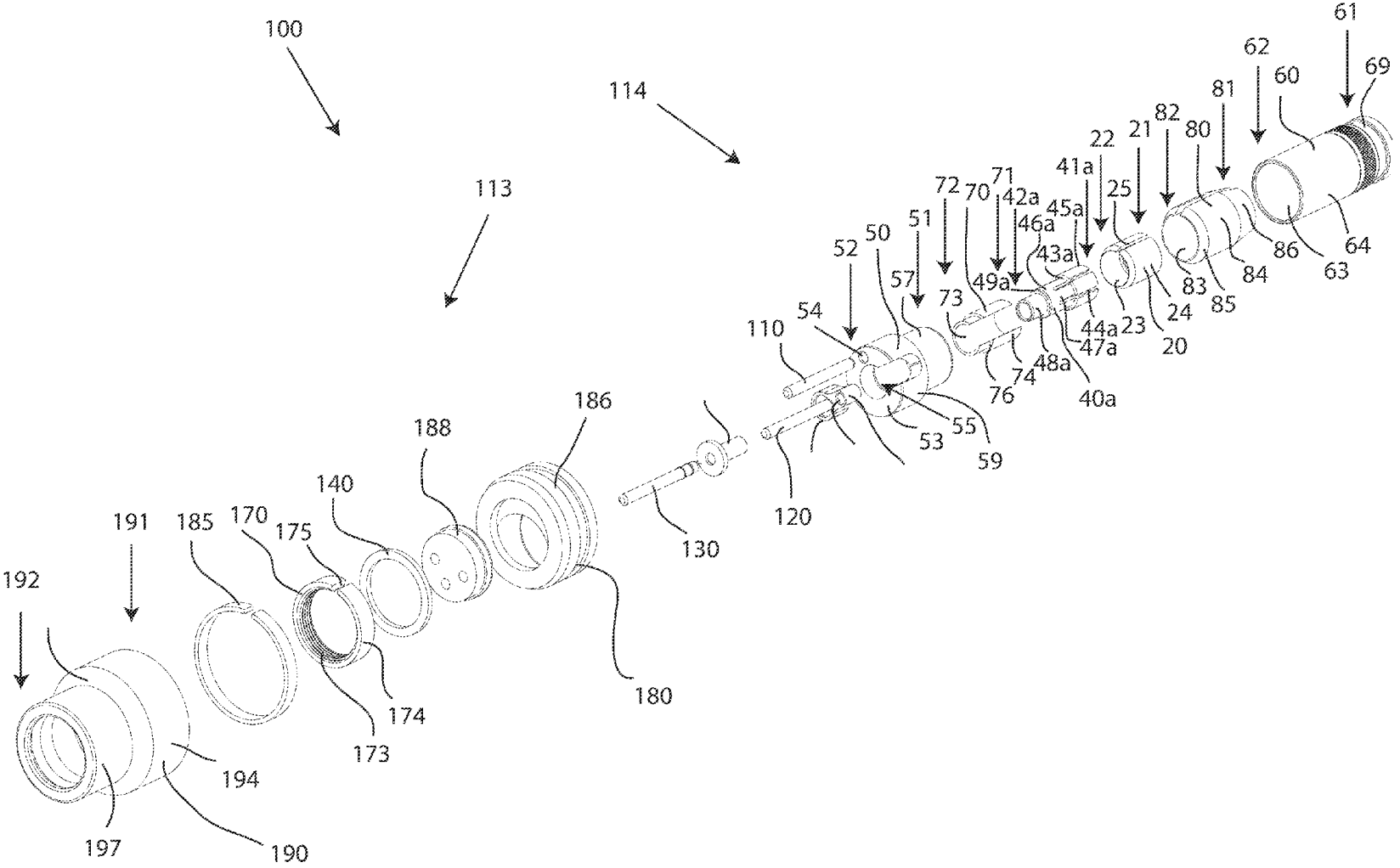
FIG. 3B depicts an exploded perspective view of the first embodiment of a multi-conductor cable connector, wherein the cable connection portion is a compression connector.
Figure 3C:
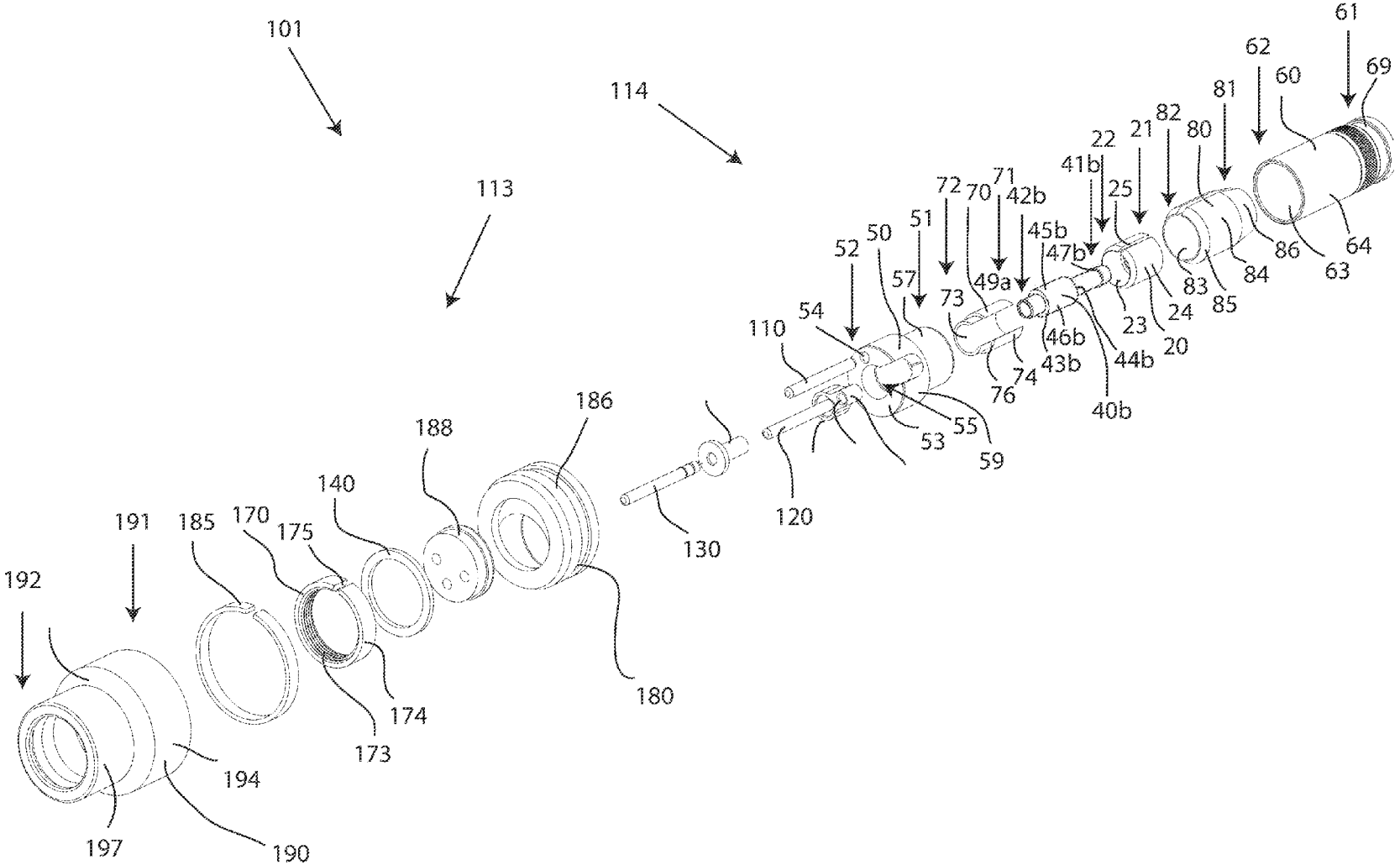
FIG. 3C depicts an exploded perspective view of the first embodiment of a multi-conductor cable connector, wherein the cable connection portion is a compression connector incorporating a post.

Referring now to FIGS. 3A-3C, embodiments of a cable connection portion 114 of multi-conductor cable connector 100 may be various cable connector configurations. For example, the cable connection portion 114 may be a soldered connection, welded connection, overmold configuration, crimped connection, compression connector, and the like. Cable connection portion 114 may receive a plurality of conductive strands, wherein a plurality of electrical contacts 110, 120, 130 are in communication (e.g. electrical and/or mechanical contact) with the plurality of conductive strands being received by the cable connection portion 114. FIG. 3A depicts an embodiment of cable connection portion 114 being a soldered connection, wherein a plurality of conductive strands can be soldered to a plurality of electrical contacts 110, 120, 130 associated with the connector engagement portion 113. Therefore, connector engagement portion 113 may be coupled to cable connection 114, wherein the cable connection portion 114 may be a compression connector, a soldered connection, overmold configuration, crimped connection, welded connection, or other cable connector configurations. The cable connection portion 114 of connector 100 may be the first cable connection portion of connection pair 5.

Referring now to 3B, embodiments of a cable connection portion 114 will now be described as a compression connector for exemplary purposes; however, cable connection portion 114 may not be a compression connector. Cable connection portion 114 may include a slotted contact member 40*a*, a connector body 50, a conductive member 80, a fastener member 60, an inner sleeve 20, a contact component 30, a separator 70, and a spacer 137. In other embodiments, such as an embodiment of connector 101, a post 40*b* may be included instead of a slotted contact member 40*a*, as depicted in FIG. 3C.

An embodiment of a cable connection portion 114 may include a slotted contact member 40*a*. The slotted contact member may have a first end 41*a* and a second end 42*a*. The slotted contact member 40*a* may include a raised portion 45*a* proximate the first end 41*a*, wherein the inner diameter of the slotted contact member 40*a* is greater than other sections of the slotted contact member 40*a*. The raised portion 45*a* may form an edge 43*a* which may be perpendicularly aligned with the outer surface 46*a* of the slotted contact member 40*a*, or may have any alignment or orientation that could provide a mating edge and/or surface for another component of the multi-conductor cable connector 100. For example, edge 43*a* may form a right angle with the surface 46*a* of the slotted contact member 40*a*, or be a tapered surface to accommodate mating with different shaped components. The edge 43*a* of the slotted contact member 40*a* may be configured to make physical and electrical contact with a corresponding mating surface 36 of a contact component 30. For instance, the mating edge surface, such as edge 43*a* of the slotted contact member 40*a* may abut, contact, communicate, border, touch, press against, and/or adjacently join with a mating surface, such as mating edge 36, of the contact component 30.

Furthermore, the raised 45*a* of the slotted contact member 40*a* may be located proximate or otherwise near a first annular recess 47*a*, wherein the first annular recess 47*a* is proximate or otherwise near a second annular recess 48*a*. The second annular recess 48*a* may be proximate or otherwise near the second end 42*a* of the slotted contact member 40*a*. The orientation and positioning, including axial length across the slotted contact member 40*a*, of the first annular recess 47*a*, second annular recess 48*a*, and the raised portion 45*a* of the first annular recess 47*a*, the second annular recess 48*a*, and the raised portion 45*a* may vary to sufficiently accommodate and/or mate with the contact component 30, depending on the size or desired location of the contact component 30 and inner sleeve 20. Moreover, the difference in outer diameter between the first annular recess 47*a* and the second annular recess 48*a* may form a lip 49*a*, such as a lip or edge, face, and the like that may engage a portion of an inner sleeve 20. The outer surface 46*a* of the slotted contact member 40*a* may be tapered from the lip 49*a* to the first end 41*a* to engage portions of other connector 100 having ramped or opposingly tapered mating edges. Additionally, the slotted contact member 40 may include one or more axial slots 44*a*. Slots 44*a* may be openings, slots, grooves, channels, apertures, and the like that may extend, typically axially, through the slotted contact member 40. The slots 44*a* may provide a more resilient relationship with the surrounding components of connector 100, which may establish and maintain continuous electrical and physical contact therebetween. The slots 44*a* may axially extend from the first end 41*a* through at least a portion of the first annular recess 47*a*. In other embodiments, the slots 44*a* may extend through only the raised portion 45*a* or only a portion of the raised portion 45*a*, or the slots 44*a* may extend through the first annular recess 47*a* and through at least a portion of the second annular recess 48*a*.

Furthermore, the slotted contact member 40*a* should be formed such that portions of a prepared multi-conductor cable 10, 11 (as shown in FIGS. 2 and 10) including the dielectric 16 (and possibly a conductive foil 15 tightly surrounding the interior dielectric 16), and center conductive strand 18*a*, 18*b* can pass axially into the first end 41 and/or through a portion of the tube-like body of the slotted contact member 40*a*. Moreover, the slotted contact member 40*a* should be dimensioned such that the slotted contact member 40*a* may be inserted into an end of the prepared multi-conductor cable 10, 11, around the surrounding the dielectric 16 (and possible conductive foil 15) and under the first and second protective outer jackets 12*a*, 12*b* and the first and second conductive strand layers 14*a*, 14*b*. Accordingly, where an embodiment of the slotted contact member 40*a* may be inserted into an end of the prepared multi-conductor cable 10, 11 under the drawn back conductive strand layer 14*a*, substantial physical and/or electrical contact with the first shield 14*a* may be accomplished thereby facilitating electrical continuity through the slotted contact member 40*a*. The slotted contact member 40*a* may be formed of metals or other conductive materials that would facilitate a rigidly formed post body. In addition, the slotted contact member 40*a* may be formed of a combination of both conductive and non-conductive materials. For example, a metal coating or layer may be applied to a polymer of other non-conductive material. Manufacture of the slotted contact member 40*a* may include casting, extruding, cutting, turning, drilling, knurling, injection molding, spraying, blow molding, component overmolding, or other fabrication methods that may provide efficient production of the component.

FIG. 3C shows an alternative embodiment of a multi-conductor cable connector 101. Connector 101 can have a cable engagement portion 114 being a compression connector including a post 40*b* instead of a slotted contact member 40*a*. The post 40*b* may include a first end 41*b* and an opposing second end 42*b*. Furthermore, the post 40*b* may include a thicker portion 45*b* where the thickness of the post 40*b* is greater than other sections of the post 40*b*. The thicker portion 45*b* has a first edge 43*b* and a second edge 44*b*. The first and second edges 43*b*, 44*b* may be perpendicularly aligned with the outer surface 46*b* of the post 40*b*, or may have any alignment or orientation that could provide a mating edge and/or surface for another component of the multi-conductor cable connector 100. For example, the first and second edges 43*b*, 44*b* may form a right angle with the surface 46*b* of the post 40*b*, or be a tapered surface to accommodate different shaped components. The first edge 43*b* may be configured to make physical and electrical contact with a corresponding mating surface 36 of a contact component 30. For instance, the mating edge surface, such as first edge 43*b* of thicker portion 45*b* of the post 40*b* may abut, contact, communicate, border, touch, press against, and/or adjacently join with a mating surface, such as mating edge 36, of the contact component 30.

Furthermore, the thicker portion 45*b* of the post 40*b* may be a raised portion, an annular extension, an oversized barrel portion, and the like, or may be a separate annular tubular member that tightly surrounds or generally substantially surrounds a portion of the post 40*b*, increasing the thickness of the post 40*b* for that particular section. The thicker portion 45*b* may be located proximate or otherwise near the second end 42*b* of the post 40*b*. Alternatively, the thicker portion 45*b* may be positioned a distance away from the second end 42*b* to sufficiently accommodate and/or mate with the contact component 30, depending on the size or desired location of the contact component 30 with respect to the size and/or location of the post 40*b*. Moreover, the post 40*b* may include a lip 47*b* proximate or otherwise near the first end 41*b*, such as a lip or protrusion that may engage a portion of an inner sleeve 20. The outer surface 46*b* of the post 40*b* may be tapered from the lip 47*b* to the first end 41*b*. However, the post may not include such a surface feature, such as lip 47*b*, and the cable connection portion 114 may rely on press-fitting and friction-fitting forces and/or other component structures to help retain the post 40*b* in secure location both axially and rotationally relative to the inner sleeve 20 and conductive member 80.

Moreover, the post 40*b* should be formed such that portions of a prepared multi-conductor cable 10, 11 (as shown in FIGS. 2 and 10) including the dielectric 16 (and possibly a conductive foil 15 tightly surrounding the interior dielectric 16), and center conductive strand 18*a*, 18*b* can pass axially into the first end 41 and/or through a portion of the tube-like body of the post 40*b*. Moreover, the post 40*b* should be dimensioned such that the post 40*b* may be inserted into an end of the prepared multi-conductor cable 10, around the surrounding the dielectric 16 (and possible conductive foil 15) and under the first and second protective outer jackets 12*a*, 12*b* and the first and second conductive strand layers 14*a*, 14*b*. Accordingly, where an embodiment of the post 40*b* may be inserted into an end of the prepared multi-conductor cable 10 under the drawn back conductive strand layer 14*a*, substantial physical and/or electrical contact with the first shield 14*a* may be accomplished thereby facilitating electrical continuity through the post 40*b*. The post 40*b* may be formed of metals or other conductive materials that would facilitate a rigidly formed post body. In addition, the post 40*b* may be formed of a combination of both conductive and non-conductive materials. For example, a metal coating or layer may be applied to a polymer of other non-conductive material. Manufacture of the post 40*b* may include casting, extruding, cutting, turning, drilling, knurling, injection molding, spraying, blow molding, component overmolding, or other fabrication methods that may provide efficient production of the component.

With reference now to FIGS. 3B and 3C, embodiments of a cable connection portion 114 may include a connector body 50. The connector body 50 may comprise a first end 51, opposing second end 52, and an outer surface 59. Proximate or otherwise near the second end 52, the connector body includes a mating surface 53, which may be configured to abut, contact, communicate, border, touch, press against, and/or adjacently join with a mating surface(s), such as an internal lip 196 and plate 188 of outer housing 190, and even spacer 137. Located somewhere on the mating surface 53 may be a first contact opening 54. The first contact opening 54 may accept, accommodate, receive, etc. a first contact 110, and may be an opening, a hole, a bore, a tubular pathway, and the like. In most embodiments, the first contact 110 configured to be inserted into the first contact opening 54 extends a continuous electrical ground path throughout the multi-conductor cable connector 100. The location of the first contact opening 54 may correspond to an arrangement of the first contact 110, wherein the first contact may share a non-concentric or other alignment with a second contact 120 and a third contact 130. The alignment of the contacts 110, 120, 130 may be concentric, non-concentric alignment, or any such alignment associated with various multi-conductor cables designs and standards, such as XLR cables and other multi-conductor cables.

Furthermore, the connector body 50 may include an opening 55 proximate or otherwise the near the second end 52 which may be dimensioned to allow the contact component 30, separator 70, and a portion of the slotted contact member 40*a* or post 40*b* to be disposed therein. The opening 55 may be any opening, void, space, cut-out, and the like, which may represent a removed portion of the connector body 50 which may provide clearance for the contact component 30, the insert 170, and a portion of the second end 42*a* of the slotted contact member 40*a* (or second end 42*b* of the post 40*b*). The connector body 50 may also include an internal lip 56, such as a lip or annularly extending protrusion proximate or otherwise near the second end 52, wherein the internal lip 56 may engage a portion of the separator 70, in particular, an outer lip 76 of the separator 70.

Moreover, the connector body 50 may include an annular recess 57 located proximate or otherwise near the first end 51. The outer annular recess 57 may share the same inner surface 58 and may have the same inner diameter as the connector body 50, but may have smaller outer diameter than the connector body 50. The inner diameter of the connector body 50 should be large enough to allow the slotted contact member 40*a*, or post 40*b*, to pass axially through the first end 51. Additionally, the connector body 50 may include an annular ramped surface proximate or otherwise near the first end 51 configured to mate with a corresponding annular ramped surface of a conductive member 80. The physical contact between the annular ramped surfaces of the connector body 50 and the conductive member 80 establishes and maintains a continuous electrical ground path throughout the multi-conductor cable 100. Those skilled in the art should appreciate that physical contact may be established and maintained between the connector body 50 and the conductive member 80 without corresponding annular ramped surfaces. For instance, the corresponding mating surfaces may interact with each other by various shapes and/or means, such as abutting flat surfaces, etc. Furthermore, the connector body 50 should be formed of conductive materials to facilitate a continuous electrical ground path throughout the connector 100. Manufacture of the connector body 50 may include casting, extruding, cutting, turning, drilling, injection molding, spraying, blow molding, component overmolding, combinations thereof, or other fabrication methods that may provide efficient production of the component.

With further reference to FIGS. 3B and 3C, embodiments of a multi-conductor cable connector 100 may include a conductive member 80. The conductive member includes a first end 81, an opposing second end 82, an outer surface 83, and an inner surface 84. The conductive member 80 may have a generally axial opening therethrough. The conductive member 80 may include a first annular ramped surface 85 proximate or otherwise near the second end 82 that may be configured to mate with a corresponding annular ramped surface of the connector body 50 to extend a continuous electrical ground path throughout the connector 100. The conductive member 80 may also include a second annular ramped surface 86 proximate or otherwise near the first end 81 which may be configured to mate with the ramped surface 66 of the fastener member 60 to compress the components of the cable connection portion 114. The conductive member 80 may also include an annular groove 87 proximate or otherwise near the first end 81.

Moreover, the conductive member 80 may be disposed over an inner sleeve 20 and the slotted contact member 40*a*, or in other embodiments, the post 40*b*. Specifically, a first portion of the inner surface 84 proximate or closer to the second end 82 of the conductive member 80 may physically contact the outer surface 24 of the inner sleeve 20 while operably configured, preventing physical and electrical contact with the conductive slotted contact member 40*a*, or post 40*b*. A second portion of the inner surface 84 proximate or closer to the first end 81 of the conductive member 80 may physically and electrically contact the drawn back and exposed second conductive grounding shield 14*b* to facilitate a continuous electrical ground path from the second conductive grounding shield 14*b* to the connector body 50. Furthermore, the conductive member 80 should be formed of conductive materials to facilitate a continuous electrical path throughout the connector 100. Manufacture of the conductive member 80 may include casting, extruding, cutting, turning, drilling, injection molding, spraying, blow molding, component overmolding, combinations thereof, or other fabrication methods that may provide efficient production of the component.

Referring still to FIGS. 3B and 3C, embodiments of a of a multi-conductor cable connector 100 and/or 200 may include a fastener member 60. The fastener member 60 may have a first end 61, opposing second end 62, an inner surface 63, and an outer surface 64. In one embodiment, the fastener member 60 may be a compression ring or tubular cylindrical member. The fastener member 60 may be radially disposed over the conductive member 80 and a portion of the connector body 50, in particular, the annular recess 57 of the connector body 50. For example, the outer surface 59 of the connector body 50 and the outer surface 83 of the conductive member 80 may physically contact the inner surface 63 of the fastener member 60. In addition, the fastener member 60 may comprise a central passageway 65 defined between the first end 61 and second end 62 and extending axially through the fastener member 60. The central passageway 65 may comprise a ramped surface 66 proximate or otherwise near the first end 61 which may be configured to mate with the second ramped surface of the conductive member 80. The ramped surface 66 may act to compress the outer surface 84 of the conductive member 80 when the fastener member 60 is operated to secure a multi-conductor cable 10. For example, the narrowing geometry will compress squeeze against the conductive member 80 and other components, when the fastener member 60 is compressed into a tight and secured position. Additionally, the fastener member 60 may comprise an exterior surface feature 69 positioned proximate with or close to the first end 61 of the fastener member 60. The surface feature 69 may facilitate gripping of the fastener member 60 during operation of the cable connection portion 114. Although the surface feature 69 is shown as an annular detent, it may have various shapes and sizes such as a ridge, notch, protrusion, knurling, or other friction or gripping type arrangements. The second end 62 of the fastener member 60 may extend an axial distance so that, when the fastener member 60 is compressed into sealing position, the fastener member 60 touches or resides substantially proximate or significantly close to the annular recess 57 of the connector body 50. It should be recognized, by those skilled in the requisite art, that the fastener member 60 may be formed of conductive or non-conductive rigid materials such as metals, hard plastics, polymers, composites and the like, and/or combinations thereof. Furthermore, the fastener member 60 may be manufactured via casting, extruding, cutting, turning, drilling, injection molding, spraying, blow molding, component overmolding, combinations thereof, or other fabrication methods that may provide efficient production of the component.

Referring still to FIGS. 3B and 3C, further embodiments of cable connection portion 114 may also include an inner sleeve 20. The inner sleeve 20 may include a first end 21, an opposing second end 22, an inner surface 23, and an outer surface 24. The inner sleeve may also include an opening 25 running axially along the inner sleeve 20. The opening 25 may be a slit, slot, opening, or aperture between two portions of the inner sleeve 20. In one embodiment, opening 25 may be formed by an abutment of two edges of a curved piece of polymeric material, such as inner sleeve 20. Alternatively, the opening 25 may be formed by cutting, slicing, scoring, piercing, etc. a whole, one-piece inner sleeve 20 in an axial direction along from a first end 21 to a second end 22. During installation, the inner sleeve 20 may be spread open because of the opening 25 and then subsequently radially disposed over the slotted contact member 40*a*, or in other embodiments, the post 40*b*. Because the inner sleeve 20 is resilient, it can regain a generally annular or cylindrical shape and encompass or substantially surround the post 40*b*.

The inner sleeve 20 may be disposed between the conductive member 80 and the post 40*b* which may prevent physical and electrical contact between the conductive member 80 and the post 40*b*. The inner sleeve 20, may also physically and electromagnetically separate and shield the first conductive strand layer 14*a* from physical and/or electrical contact with the second conductive strand layer 14*b*. Specifically, the inner sleeve 20 substantially or generally surrounds, encompasses, and/or has a radial relationship with a portion of the slotted contact member 40*a*, or post 40*b*. Additionally, the inner sleeve 20 may include a lip 26 proximate or otherwise near the second end 22. The inner sleeve 20 may also include an annular detent 27 proximate or otherwise near the first end 21. The annular detent 27 may dimensionally correspond to the annular lip 46*b* of the post 40*b* for possible engagement at that location with the post 40*b*. Moreover, the inner sleeve 20 should be formed of non-conductive materials, such as an insulator. Moreover, the inner sleeve 20 may be formed of a polymeric material, such as rubber or plastic, or any resilient or semi-resilient insulating material responsive to radial compression and/or deformation. Manufacture of the inner sleeve 20 may include casting, extruding, cutting, turning, drilling, compression molding, injection molding, spraying, or other fabrication methods that may provide efficient production of the component.

With continued reference to FIGS. 3B and 3C, embodiments of a cable connection portion 114 may include a contact component 30. The contact component 30 may have a first portion 31, a second portion 32, and an outer surface 33. The contact component 30 may be a conductive member having a plurality of openings to allow a plurality of electrical contacts, such as second contact 120 and third contact 130, to pass axially through, while also fitting within the parameters of the opening 55 of the connector body 50. The contact component 30 may be disposed within the opening 55 of the connector body 50. Moreover, the contact component 30 may be suspended within the opening 55 of the connector body 50, preserving a general clearance with the connector body 50. In some embodiments, while the contact component 30 is disposed within the opening 55 of the connector body 50, the contact component 30 is suspended by the insert 170 to provide a clearance between the contact component 30 and the connector body 50. In other words, the contact component 30 may not physically or electrically contact the connector body 50. For example, the insert 170, described infra, may be disposed between the contact component 30 and the connector body 50. In one embodiment, the insert 170 may suspend, or otherwise locate the contact component 30 by substantially surrounding the third contact opening 35. In still other embodiments, it should be recognized that the contact component 30 may be a structural feature formed integrally with and included as part of the slotted contact member 40*a*, or the post 40*b*, so that the included integral contact component portion 30 of the slotted contact member 40*a*, or the post 40*b*, structurally and functionally operates in a manner consistent with the separate contact component 30 elementarily described herein.

Furthermore, the contact component 30 (or a corresponding feature formed integrally with and included on the post 40*b*) may include a second contact opening 34 proximate or otherwise near a first portion 31, and a third contact opening 35 proximate or otherwise near a second portion 32. The contact component 30 may also be a base section 37 with one or more openings extending therethrough, wherein the one or more openings of the base section 37 of the contact component 30 may have any orientation that may correspond with the structural positioning of the plurality of electrical contacts. The base section 37 of the contact component 30 may be a section of conductive material that includes the first contact opening 34 and the second contact opening 35. Alternatively, the contact component 30 may include a base section 37 which separates the first portion 31 from the second portion 32. One of the second and third contact openings 34, 35 may be larger than the other. For example, the third contact opening 35 may have a larger diameter than the second contact opening 34 to accommodate larger diameter contacts, such as center conductive strand 18*a*, 18*b* of a multi-conductor cable 10, 11. Moreover, the connector 100, 200 may have various non-concentric alignments of the electrical contacts 110, 120, 130, or 210, 220, 230. In one embodiment, the non-concentric alignment of the contacts 110, 120, 130 or 210, 220, 230 may resemble an isosceles triangle. In another embodiment, the non-concentric alignment of the contact 110, 120, 130 or 210, 220, 230 may resemble a right triangle. In yet another embodiment, the non-concentric alignment of the contacts 110, 120, 130 or 210, 220, 230 may be a straight line configuration. Accordingly, the structure of the contact component 30 may change to accommodate the various alignments of the plurality of electrical contacts, such as contacts 110, 120, 130 or 210, 220, 230.

Because there may be various alignments of the contacts 110, 120, 130, the positioning of the first contact opening 34 and the second contact opening 35 may vary. In one embodiment, the second contact opening 34 and the third contact opening 35 are positioned in a stacked alignment (e.g. top/bottom relationship). In another embodiment, the second contact opening 34 and the third contact opening 35 are positioned in a side-by-side alignment. To achieve various alignments of the contacts 110, 120, 130, the structural positions of the connector body 50 and the contact component 30 (e.g. tilt angle of contact component 30, location/angle of opening 55) may have to be correspondingly modified to accommodate different contact 110, 120, 130 positions.

Furthermore, the second contact opening 34 may accept, accommodate, receive, etc. a second contact 120 of connector 100, and may be an opening, a hole, a bore, a tubular pathway, and the like. In most embodiments, the second contact 120 configured to be inserted into the second contact opening 34 extends a continuous electrical path throughout the multi-conductor cable connector 100. The location of the second contact opening 34 may correspond to an alignment of the second contact 120, wherein the second contact 120 shares a non-concentric or other alignment with the first contact 110 and the third contact 130. The alignment of the electrical contacts 110, 120, 130 could be any non-concentric alignment, or may be a non-concentric alignment associated with most multi-conductor cables designs and standards, such as XLR cables and similar multi-conductor cables.

Likewise, the third contact opening 35 of the contact component 30 may accept, accommodate, receive, etc. a third contact 130 of connector 100, and may be an opening, a hole, a bore, a tubular pathway, and the like. In most embodiments, the third contact 130 configured to be inserted into the third contact opening 35 extends a continuous electrical path throughout the multi-conductor cable connector 100. However, the location of the third contact opening 35 may correspond to an alignment of the third contact 130, wherein the third contact 130 shares a non-concentric or other alignment with the first contact 110 and second contact 120. The non-concentric alignment of the electrical contacts 110, 120, 130 could be any non-concentric alignment, or may be a non-concentric alignment associated with most multi-conductor cables designs and standards, such as XLR cables and similar multi-conductor cables. In most embodiments, the location of the third contact opening 35 corresponds to the location and/or alignment of a center conductive strand 18*a*, 18*b* of a multi-conductor cable 10, 11.

Furthermore, the contact component 30 may include a mating surface 36 which faces the first end 1 of the connector 100. While operably configured, the mating surface 36 may abut, contact, communicate, border, touch, press against, and/or adjacently join with the lip 49*a* of the slotted contact member 40*a*. While an embodiment of a connector 100 including a post 40*b* is operably configured, the mating surface 36 may abut, contact, communicate, border, touch, press against, and/or adjacently join with the first edge 43*b* of the thicker portion 45*b* of the post 40*b*. Because the slotted contact member 40*a* (or post 40*b*) is in physical and electrical contact with the drawn back and exposed first conductive strand layer 14*a*, the physical and electrical contact between the lip 49*a* of the slotted contact member 40*a* (alternatively the physical and electrical contact between the first edge 43 of the post 40*b*) and the mating surface 36 of the contact component 30 establishes and maintains a continuous electrical path between the slotted contact member 40*a* (or post 40*b*) and the contact component 30. Thus, a continuous electrical path exists from the first conductive strand layer 14*a* to a second pin 120 positioned within the second pin opening 34, due to the conductive communication between the conductive contact component 30 and the second contact 120. Moreover, manufacture of the contact component 30 may include casting, extruding, cutting, turning, rolling, stamping, photo-etching, laser-cutting, water-jet cutting, and/or other fabrication methods that may provide efficient production of the component.

Referring still to FIGS. 3B and 3C, embodiments of a cable connection portion 114 of a multi-conductor cable connector 100 may include a separator 70. The separator 70 may have a first end 71, a second end 72, an inner surface 73, and an outer surface 74. The separator 70 may be disposed between the contact component 30 and the connector body 50. Alternatively, the separator 70 may be a sleeve for the contact component 30, in particular, the second portion 32 of the contact component 30. In most embodiments, the separator 70 is radially disposed over the second end 42 of the post 40*b* without physical contact with the post 40*b*, but substantially surrounding the second portion 32 of the contact component 30. For instance, the separator 70 may be radially disposed over the post 40*b* from the second end 42 to the first edge 43 of the thicker portion 45, wherein the inner surface 73 of the separator 70 may physically contact the outer surface 33 of the contact component 30. Additionally, the outer surface 73 of the separator 70 may physically contact the inner surface 58 of the connector body 50.

Moreover, the separator 70 may be a substantially annular member. For instance, the separator 70 may have an opening running axially along the separator 70 from the first end 71 to the second end 72. The separator 70 may radially surround a majority of the second portion 32 of the contact component 30 to prevent physical and electrical contact between the contact component 30 and the connector body 50. Additionally, the separator 70 may include an outer annular lip 76 that may mate, engage, touch, abut, contact, or reside substantially close to the internal lip 56 of the connector body 50. The outer annular lip 76 may provide, ensure, support, or compliment a clearance between the connector body 50 and the post 40*b*. Furthermore, the separator 70 should be made of non-conductive, insulator materials. Manufacture of the separator 70 may include casting, extruding, cutting, turning, drilling, compression molding, injection molding, spraying, or other fabrication methods that may provide efficient production of the component.

Additionally, embodiments of a cable connection portion 114 may include a spacer 137. The spacer 137 may be a generally cylindrical member having an outwardly extending flange. The third contact 130 may pass axially through the spacer 137. In other words, the spacer 137 may be radially disposed over the third contact 130, wherein the spacer 137 is also axially disposed within the slotted contact member 40*a* proximate the second 42*a* of the slotted contact member 40*a*. In other embodiments, the spacer 137 is axially disposed within the post 40*b* proximate or otherwise near the second ends 42*a*, 42*b* of the slotted contact member 40*a*, or post 40*b*, respectively. The spacer 137 may physically contact the third contact 130, the slotted contact member 40*a* (or post 40*b*), the contact plate 188, the dielectric 16, the contact component 30, the inner body 180 and the connector body 50 to effectuate sufficient tightness, fitting, and/or tolerances between those components. Moreover, the spacer 137 should be made of non-conductive materials, such as an insulating material. Manufacture of the spacer 137 may include casting, extruding, cutting, turning, drilling, compression molding, injection molding, spraying, or other fabrication methods that may provide efficient production of the component.

In one embodiment, the manner in which the cable connection portion 114 may be fastened to a multi-conductor cable 10 may involve compaction of the conductive member 80, for example, by operation of a fastener member 60. For example, once received, or operably inserted into the connector 100, the multi-conductor cable 10 may be securely set into position by compacting and deforming the outer surface 84 of conductive member 80 against the multi-conductor cable 10 thereby affixing the cable into position and sealing the connection. Compaction and deformation of the conductive member 80 may be effectuated by physical compression caused by a fastener member 60, wherein the fastener member 60 constricts and locks the conductive member 80 into place.

As described herein above with respect to the cable connection portion 114 of embodiments of a multi-conductor cable connector 100, similar structural and functional integrity may be maintained for similar component elements of a cable connection portion 214 of embodiments of a multi-conductor cable connector 200. The various component elements of a cable connection portion 114 of a multi-conductor cable connector 100 may be substantially similar in design and operability both separately and as assembled in a corresponding cable connection portion 214 of a multi-conductor cable connector device 200. Moreover, embodiments of a cable connection portion 214 of multi-conductor cable connector 200 may be various cable connector configurations. For example, the cable connection portion 214 may be a soldered connection, welded connection, overmold configuration, crimped connection, compression connector, and the like. Therefore, connector engagement portion 213 may also be coupled to cable connection portion 214, wherein the cable connection portion 214 may be a compression connector, a soldered connection, overmold configuration, crimped connection, welded connection, or other cable connector configurations. The cable connection portion 214 of connector 200 may be the second cable connection portion of connection pair 5.

Embodiments of a cable connection portion 214 may include the same or substantially similar components as cable connection portion 114. For instance, if cable connection portion 214 is a compression connector, it may include a slotted contact member 40*a*, a connector body 50, a conductive member 80, a fastener member 60, an inner sleeve 20, a contact component 30, a separator 70, and a spacer 135, as described supra. In other embodiments, such as an embodiment of connector 101, the cable connection portion 214 may include a post 40*b*, instead of a slotted contact member 40*a*. The cable connection portion 214 of connector 200 may be the second cable connection portion of connection pair 5.

Figure 4:
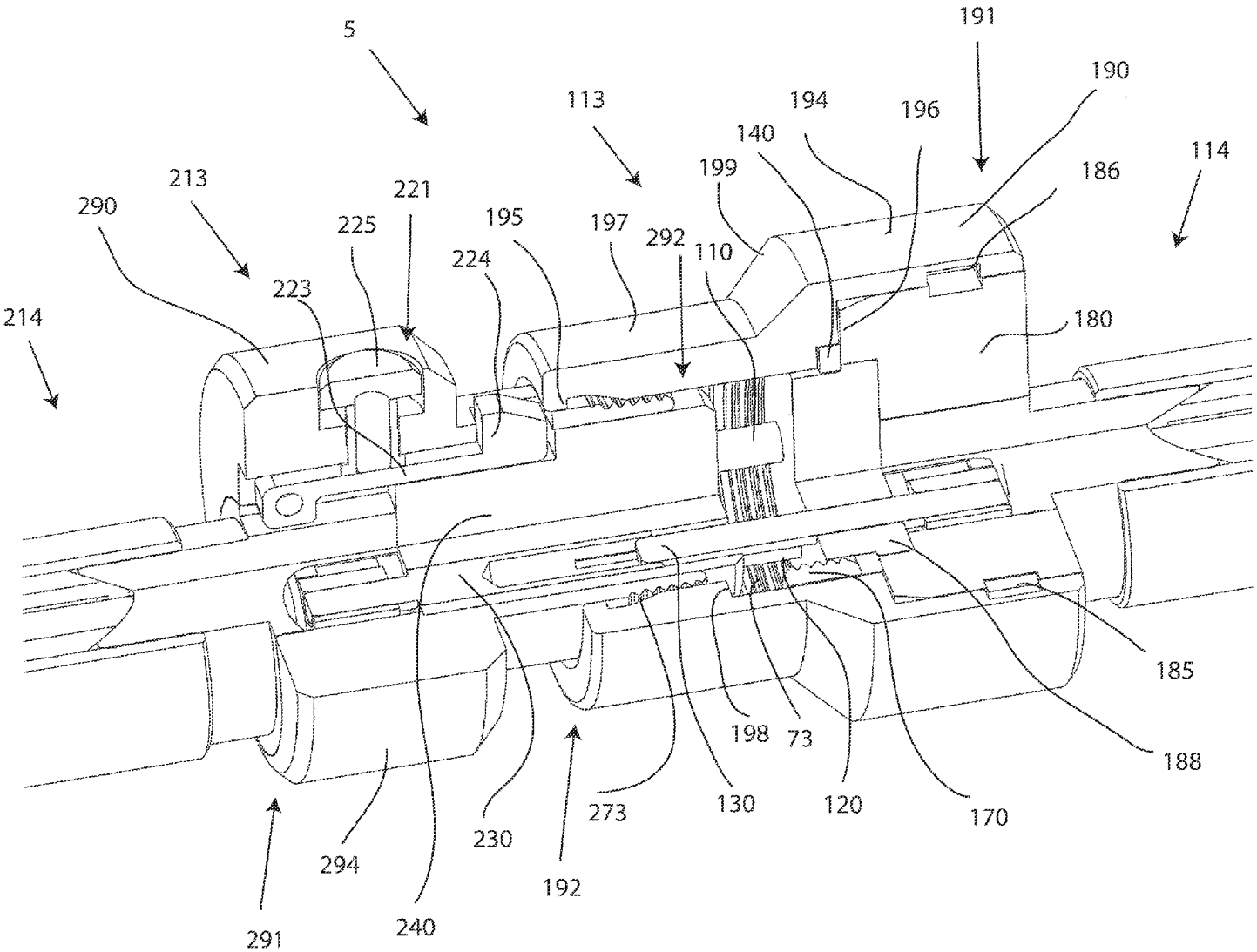
FIG. 4 depicts a partially cut-away perspective view of an embodiment of the female multi-conductor cable connector and an embodiment of a male multi-conductor cable connector, in a partially mated position.

With continued reference to FIGS. 3A-3C, and additional reference to FIG. 4, embodiments of a male-type multi-conductor cable connector 100 may include a connector engagement portion 113. The male-type cable engagement portion 113 can be the first cable engagement portion of a cable connection pair 5. The connector engagement portion 113 may include a male outer housing 190 having an integral key feature 150, an inner body 180 a metal ring 185 which allows independent rotational movement about the cable connection portion 114, an elastomer ring 140, a threaded insert 170, a first contact 110, a second contact 120, and a third contact 130. Connector engagement portion 113 may be any male-type multi-conductor plug, such as an XLR, XLR3, any XLR type plug/cable, phone plug, audio plug, stereo plug, and the like, having at least one of the components described herein, and may be compatible with any standard female-type multi-conductor plug/connector. For example, a connector 100 having a connector engagement portion 113 can still mate with a corresponding multi-conductor cable connector (e.g. a female multi-conductor cable connector) whether or not the corresponding connector has external threads or other threaded engagement feature.

Embodiments of a connector engagement portion 113 may include an outer housing 190. The outer housing 190 may have a first end 191, a second end 192, an inner surface 193, and an outer surface 194. The outer housing 190 can have a generally axial opening from the first end 191 to the second end 192. The generally axial opening may be defined by a first inner diameter, $d_1$, proximate or otherwise near the first end 191 and a second inner diameter, $d_2$, proximate or otherwise closer to the second end 192 of the outer housing 190. The first inner diameter, $d_1$, of the outer housing 190 may be large enough to allow the inner body 180 and a portion of the connector body 50 to pass axially through the first end 191, or dimensioned such that the connector body 50 may reside substantially within the outer housing 190 proximate or otherwise near the first end 191. Moreover, the outer housing 190 may include an internal lip 196 located within the generally axial opening of the outer housing 190. The internal lip 196 may be an annular edge or surface that can define and/or measure the difference (e.g. overall size of opening, diameter, and circumference) between the first inner diameter, $d_1$, and the second inner diameter, $d_2$. For example, if the outer housing 190 includes an internal lip 196, the first inner diameter, $d_1$, of the outer housing 190 will be larger than the second inner diameter, $d_2$, of the outer housing 190. The second inner diameter, $d_2$, of the outer housing 190 may be large enough to provide sufficient clearance and/or access to the threaded insert 170 and the plurality of contacts 110, 120, 130 configured to engage with the cable connection portion 114. Additionally, a contact plate 188 having a diameter slightly smaller or generally smaller than the second inner diameter, $d_2$, of the outer housing 190 may be axially inserted at the second end 192 until it engages with the components of the cable connection portion 114, including the connector body 50, which prevents further axial movement of the contact plate 188. The contact plate 188, which is formed of insulating material, may have a plurality of openings that correspond to the alignment (concentric, non-concentric, or otherwise) of the contacts, such as first contact 110, second contact 120, and third contact 130. Proximate the second end 192 of the male outer housing 190 may be an internal stop 198. Internal stop 198 may be a lip, edge, annular protrusion, and the like, which may annularly or semi-annularly extend around the inner surface 193 and laterally protrude a distance into the general axial opening of the outer housing 190 from the inner surface 193 and form an edge, or surface which may hinder further axial movement of the threaded insert 170 within the male outer housing 190. In other words, the internal stop 198 may prevent axial movement of the threaded insert 170 beyond the internal stop 198 in a direction towards the second end 192 of the rotatable outer housing 190.

Furthermore, outer housing 190 may include an annular recess 197 located proximate or otherwise near the second end 192. The outer housing 190 may also include a tapered surface 199 which resides proximate or otherwise near the outer annular recess 197. The combination of the annular recess 197 and the first inner diameter may lead to a smaller thickness proximate or otherwise near the first end 191 than the thickness proximate the second end 192. Additionally, the outer housing 190 may be located proximate or otherwise near the second end 2 of the multi-conductor cable 100. Specifically, the outer housing 190 may be disposed over a portion of the connector body 50. Thus, a portion of the first, second, and third contacts 110, 120, 130 may be located within the general axial opening of the outer housing 190, while the remaining portion of the contacts 110, 120, 130 may enter the cable connection portion 114. The outer housing 190 may be formed of conductive or non-conductive materials, or a combination of conductive and non-conductive materials. For example the outer or external surface 194 of the outer housing 190 may be formed of a polymer, while the remainder of the outer housing 190 may be comprised of a metal or other conductive material. Moreover, the outer housing 190 does not have to be in electrical communication or contact with the outermost conductor, such the second conductive strand layer 14*b* of a prepared coaxial cable 10, 11. For instance, the outer housing 190 may be made of non-conductive material(s) without preventing the operation of the electrical paths through the connector 100, 200. The outer housing 190 may be formed of metals or polymers or other materials that would facilitate a rigidly formed housing 190. Embodiments of outer housing 190 may be a male outer housing 190 mates with a female outer housing 290.

Referring still to FIG. 3A-FIG. 4, the male outer housing 190 may be rotatable about a connector engagement portion 213 of a corresponding multi-conductor cable connector, such as female type connector 200, and the rotatable outer housing 190 may rotate about the cable connection portion 114 of a male type multi-conductor cable 100. The outer housing 190 may rotate about the cable connection portion 114 without moving in the axial direction. To facilitate rotational movement of the outer housing 190, embodiments of cable engagement portion 113 may include an inner body 180. The inner body 180 has an inner surface 183 and an outer surface 184, and may be a generally annular member having a generally axial opening. The inner body 180 may be disposed within the outer housing 190. In most embodiments, the inner body 180 may be disposed radially within the outer housing 190, between the internal lip 196 and the first end 191 of the outer housing 190. At least one groove 186 or channel may be placed on the outer surface 134 of the inner body 180, wherein the at least one groove 186 accepts a semi-flexible annular or semi-annular metal ring 185, such as a snap ring or retaining ring. The metal ring 185 may disposed within one of the annular grooves 186 to allow the outer housing 190 to achieve rotational movement independent of the inner body 180, connector body 50, and the other components of the cable connection portion 114 and cable engagement portion 113, while preventing any axial movement of the outer housing 190. The annular groove(s) 186 may be grooves, openings, annular notches, and the like, which extend around the inner body 180. Rotational movement of the outer housing 190 may facilitate the securing or locking of a corresponding multi-conductor cable connector, such as female type connector 200 to a securably joined position from a fully mated position, as described supra. For instance, the rotational movement of the outer housing 190 is translated to axial movement of the threaded insert 170. In addition, the rotational movement of the outer housing 190 may be in both the clockwise direction and the counter-clockwise direction, and have rotational capabilities in full 360° of rotation. Those skilled in the requisite art should appreciate that rotational movement of the outer housing 190 may be achieved by means other than utilizing a flexible metal ring 185, such as a snap ring or other equivalent.

Figure 5:
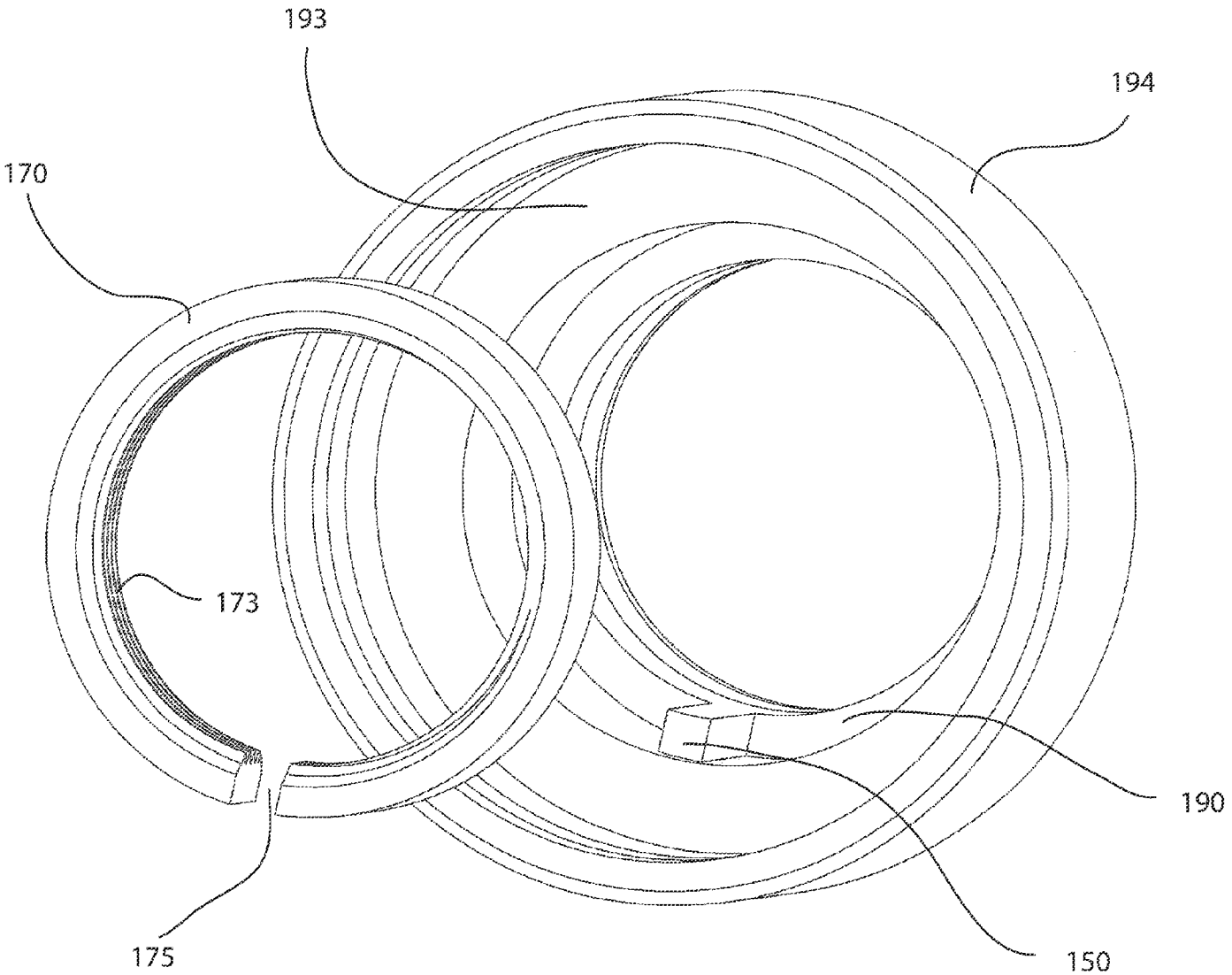
FIG. 5 depicts a perspective view of an embodiment of a threadable insert and an embodiment of a male outer housing of an embodiment of a male multi-conductor cable connector.

Furthermore, embodiments of a male multi-conductor cable connector 100 may include a moveable threaded insert 170. For instance, disposed within the general axial opening of the outer housing 190 is a threaded insert 170. The threaded insert 170 may be a generally annular member with a slot 175, wherein the slot 175 may provide clearance for an integral key 150 of the outer housing 190, as depicted in FIG. 5. The slot 175 may also be a keyway, and may define a space between two ends of the substantially annular threaded insert 170. The slot 175 need not extend completely through the threaded insert 170, for example, the slot 175 could simply be a notch in the threaded insert 170 that extends only partially through the threaded insert 170. The threaded insert 170 may have the same or substantially the same curvature as the second inner diameter, $d_2$, and have a slightly smaller diameter the second inner diameter, $d_2$. For example, the threaded insert 170 may be sized and dimensioned for a friction and/or tolerance fit within the outer housing 190. In another embodiment, the threaded insert 170 may have a diameter such that there is very little tolerance between the threaded insert 170 and the inner surface 193 of the outer housing 190. In other embodiments, the threaded insert 170 may freely move when not in a mated or securable position with a corresponding female multi-conductor cable 200. The threaded insert 170 has a threaded surface 173 and an outer surface 174. The threaded surface 173 may include threads that matingly correspond to threads 273 of a female-type connector, such as multi-conductor cable connector 200. For example, the threaded surface 173 of the threaded insert 170 can have threads having a pitch and depth that matingly correspond to the pitch and depth of the external threads 273 of the female outer housing 290 for advancement onto the female outer housing 290. The threaded insert can be made of a plastic, metal, or equivalent material, and may be conductive or non-conductive.

Positioned somewhere along the inner surface 193 of the outer housing 190 may be an integral key feature 150. For example, the integral key 150 may be integral with the outer housing 190, such that the key 150 and the outer housing 190 may be a single, uniform component of the cable engagement portion 113 of the multi-conductor cable connector 100. The key feature 150 can be one embodiment used to translate rotational movement of the outer housing 190 into axial movement of the threaded insert 170. Thus, the key feature 150 interacts with the threaded insert 170 to translate rotational movement of the outer housing 190 into axial movement of the threaded insert 170. The key feature 150 may be a projection extending or protruding from the outer housing 190, as shown in FIG. 5. The key 150 may extend or protrude a distance sufficient to maintain some physical contact with the threaded insert 170 when the threaded insert 170 is in the fully securably joined position, for example, when the threaded insert 170 touches or reaches the internal stop 198 of the male outer housing 190. In one embodiment, the key 150 may be a perpendicular surface feature of the outer housing 190, proximate the internal lip 196 of the outer housing 190. The key 150 of the outer housing 190 may be sized and dimensioned to fit within the slot 175 of the threaded insert 170. For example, the shape of the key 150 may correspond to the space or opening defined by the slot 175, or keyway, in the threaded insert 170. In an alternative embodiment, the outer housing may have more than one integral key feature, which may correspond to more than one keyway located on the threaded insert 170.

Further embodiments of the cable engagement portion 113 of a male multi-conductor cable connector 100 may include an elastomer ring 140 positioned proximate or otherwise near the internal lip 196 of the outer housing 190. In another embodiment, the elastomer ring 140 may be touching or abutting the inner body 180. In yet another embodiment, the elastomer ring 140 may be radially disposed within the outer housing 190, physically touching the inner surface 194 along an inner circumference. The elastomer ring 140 may be an annular member sized and dimensioned to fit radially within the outer housing 190. The elastomer ring 140 may be positioned within the outer housing 190 such that the elastomer ring 140 rotates cohesively and consistently with the outer housing 190, when the outer housing 190 is rotated by an external force. Furthermore, the elastomer ring 140 may provide an initial bias on the threaded insert 170 during an initial engagement with the external threads 273 of the female outer housing 290 to facilitate gripping between the threads 173, 273. In alternative embodiment, a spring or similar biasing member may be used to provide an initial bias against the threaded insert 170, instead of an elastomer ring 140. Additionally, the elastomer ring 140, or biasing equivalent, may be resilient enough to allow the threaded insert 170 to compress the elastomer ring 140 enough to provide clearance for a typical female connector without external threads 273 to reach a fully mated, but not fully secured, position. The elastomer ring 140 may be formed of a polymeric material, such as rubber or plastic, or any resilient or semi-resilient insulating material responsive to radial compression and/or deformation. Manufacture of the elastomer ring 140 may include casting, extruding, cutting, turning, drilling, compression molding, injection molding, spraying, or other fabrication methods that may provide efficient production of the component.

Embodiments of a multi-contact engagement portion 113 may include a first contact 110, a second contact 120, and a third contact 130. Alternative embodiments of multi-contact engagement portion 113 may have less than three electrical contacts, such as a connector having two electrical contacts. In yet another embodiment, the multi-contact engagement portion 113 may have more than three conductors, such as a connector having four electrical contacts. A contact may be a conductive element that may extend or carry an electrical current and/or signal from a first point to a second point. A contact may be a terminal, a pin, a conductor, an electrical contact, and the like. Contacts 110, 120, 130 may have various diameters, sizes, and may be arranged in any non-concentric, concentric, or other alignment throughout the connector 100. Furthermore, a contact, such as the first, second, and third contacts 110, 120, 130 may be hermaphroditic. In other words, the contacts 110, 120, 130 may be both female and male. The male electrical contacts may include spikes, or similar pointed protrusion, which may be configured to insert into a center conductive strand 18*a*. In contrast, the female electrical contact may include sockets, or similar receptacle, which may be configured to receive an exposed, protruding center conductive strand 18*b*. Thus, electrical contacts which are hermaphroditic may include a socket element at one end to receive, and a spike element at the opposing end. Moreover, the plurality of electrical contacts 110, 120, 130 may extend multiple continuous electrical paths through the connect 100, and an alignment of the contacts 110, 120, 130 may vary depending on the desired design and use of the connector 100, and the connector intended to mate with connector 100.

Referring again to FIGS. 3A-4, an embodiment of a female multi-conductor cable connector 200 is depicted. The multi-conductor cable connector embodiment 200 may have several similar features with a multi-conductor cable connector embodiment 100. However, the embodiment of a multi-conductor cable connector 200 may be a female XLR-type connector. As such, the multi-conductor cable connector 200 may include a cable connection portion 214, as described supra, and a cable engagement portion 213. Connector engagement portion 213 may be any female-type multi-conductor plug, such as an XLR, XLR3, any XLR type plug/cable, phone plug, audio plug, stereo plug, and the like, having at least one of the components described herein, and may be compatible with any standard male-type multi-conductor plug/connector. For example, a connector 200 having a connector engagement portion 213 can still mate with a corresponding multi-conductor cable connector (e.g. a male multi-conductor cable connector) whether or not the corresponding connector has a threaded insert or other threaded engagement feature.

The cable engagement portion 213 may include a female outer housing 290. The female-type cable engagement portion 213 can be the second cable engagement portion of the connection pair 5. Embodiments of a female outer housing 290 may share some structure and function of the outer housing 190, but may include additional or different structural and/or functional aspects. The female outer housing 290 may have a first end 291, a second end 292, an inner surface 293, and an outer surface 294. The outer housing 290 can have a generally axial opening from the first end 291 to the second end 292. The generally axial opening proximate the first end 291 may be large enough to allow components of the cable connection portion 214 to pass axially through the first end 291, or dimensioned such that the connector body 50 may reside substantially within the outer housing 290 proximate or otherwise near the first end 291. Moreover, the generally axial opening of the outer housing 290 may be large enough to provide sufficient clearance and/or access to the plurality of contacts 210, 220, 230 configured to engage with the cable connection portion 214. Furthermore, outer housing 290 may include an annular recess 297 located proximate or otherwise near the second end 292. The outer housing 290 may also include a tapered surface 298 which resides proximate or otherwise near the outer annular recess 297. Specifically, the outer housing 290 may be disposed over a portion of the connector body 50. Thus, a portion of the first, second, and third contacts 210, 220, 230 may be located within the generally axial opening of the outer housing 290, while the remaining portion of the contacts 210, 220, 230 may enter the cable connection portion 214. The outer housing 290 may be formed of conductive or non-conductive materials, or a combination of conductive and non-conductive materials. For example the outer or external surface 294 of the outer housing 290 may be formed of a polymer, while the remainder of the outer housing 290 may be comprised of a metal or other conductive material. Moreover, the outer housing 290 does not have to be in electrical communication or contact with the outermost conductor, such the second conductive strand layer 14*b* of a prepared coaxial cable 10, 11. For instance, the outer housing 290 may be made of non-conductive material(s) without preventing the operation of the electrical paths through the connector 100, 200. The outer housing 290 may be formed of metals or polymers or other materials that would facilitate a rigidly formed housing 290. Embodiments of outer housing 290 may be a female outer housing 290 which may mate with a male outer housing 190.

Moreover, embodiments of the female outer housing 290 can include external threads 273 located on the outer surface 294 proximate or otherwise near the second end 292 of the female outer housing 290. The threads 273 of the female connector 200 may threadably engage the threaded insert 170 of a male outer housing 190. The threaded engagement between the threaded insert 170 and the external threads 273 may securably join a male multi-conductor cable connector, such as connector 100, with a female multi-conductor cable, such as connector 200. The pitch and depth of threads 273 should matingly correspond with the pitch and depth of the threaded surface 73 of the threaded insert 170 such that the threaded insert 170 may advance onto the external threads 273 of the female connector 200 through rotational movement of the male outer housing 190. The second end 292 of the female outer housing 290, which includes the threaded surface 273, should be able to clear the internals of a standard multi-conductor cable connector, such as any XLR type connector, and should be able to engage the threaded insert 170 of the male outer housing 190. Thus, an embodiment of multi-conductor cable connector 200 having external surface threads 273 can be compatible with a typical male-type multi-conductor cable connector which does not include a threaded insert 170.

The female outer housing 290 may also include a contact receiver 240, and a securing means 221. The contact receiver 240 may include a plurality of openings 226, 227, 228 that may accept, accommodate, receive, support, and/or guide a plurality of contacts, such as the first, second, and third contacts 110, 120, 130. In most embodiments, the plurality of openings may include a first receptive contact opening 226, which corresponds to the first contact 110, a second receptive contact opening 227, which corresponds to the second contact 120, and a third receptive contact opening 228 which corresponds to the third contact 130. The orientation of the first, second, and third receptive contact openings 226, 227, 228 may correspond to the alignment of the contacts 110, 120, 130. The contact receiver 240 may be positioned within or substantially within the female outer housing 290 proximate a second end 292. In other words, the female outer housing 290 may surround or substantially surround the contact receiver 240. In one embodiment, the contact receiver 240 fits snugly within the female outer housing 290. The contact receiver 240 should be formed of non-conductive materials, such as rubber or other polymeric material. Manufacture of the contact receiver 240 may include casting, extruding, cutting, turning, drilling, compression molding, injection molding, spraying, or other fabrication methods that may provide efficient production of the component.

Furthermore, embodiments of the female outer housing 290 may also include a securing means 221. Securing means 221 may be a latching mechanism having a latch arm 223 and latch head 224. Securing means 221 may be any securing means operable with multi-conductor cable connectors known to those skilled in the art. Embodiments of latch head 224 may have a ramped surface(s) to releasably engage the male outer housing 190. The lath head 224 may engage a recessed edge 195 of the male outer housing 190 proximate or otherwise near the second end 192. The latch head 224 and the inner surface of the outer housing 190 proximate the recessed edge 195 may be opposingly or matingly tapered surfaces. A lock button 225 may be operably associated with the latch arm 223 and latch head 224 to releasably secure the male multi-conductor cable connector 100 to the female multi-conductor cable connector 200. The lock button 225 may be exposed and/or accessible on the outer surface 294 of the female outer housing 290. Those skilled in the art should appreciate that securing means 221 may be a variety of securing means typically associated with multi-conductor cables, such as XLR type cables.

Referring still to FIG. 3A-FIG. 4, embodiments of a multi-contact engagement portion 213 of connector 200 may include a first contact 210 a second contact 220 and a third contact 230. Alternative embodiments of multi-contact engagement portion 213 may have less than three electrical contacts, such as a connector having two electrical contacts. In yet another embodiment, the multi-contact engagement portion 213 may have more than three conductors, such as a connector having four electrical contacts. A contact may be a conductive element that may extend or carry an electrical current and/or signal from a first point to a second point. A contact may be a terminal, a pin, a conductor, an electrical contact, and the like. Contacts 210, 220, 230 may have various diameters, sizes, and may be arranged in any non-concentric alignment throughout the connector 200. Furthermore, a contact, such as the first, second, and third contacts 210, 220, 230 may be hermaphroditic. In other words, the contacts 210, 220, 230 may be both female and male. The male electrical contacts may include spikes, or similar pointed protrusions, which may be configured to insert into the center conductive strand 18*a*. In contrast, the female electrical contact may include sockets, or similar receptacle, which may be configured to receive an exposed, protruding center conductive strand 18*b*. Thus, electrical contacts which are hermaphroditic may include a socket element at one end to receive, and a spike element at the opposing end. Moreover, the plurality of electrical contacts 210, 220, 230 may extend multiple continuous electrical paths through the connector 200, and an alignment of the contacts 210, 220, 230 may vary depending on the desired design and use of the connector 200, and the connector intended to mate with connector 200.

Furthermore, a first contact 110 may extend a continuous electrical ground path through the connector 100. In one embodiment, a first end, or portion, of the first contact 110 may be positioned within the first contact opening 54 of the connector body 50 of the male connector 100, and a second end, or portion, may be inserted into the first receptive contact opening 226 of the female connector 200 to establish a continuous electrical ground path through the connector 200. A second contact 120 may extend a continuous electrical path through the connector 100. In one embodiment, a first end, or portion, of the second contact 120 may be positioned within the second contact opening 34 of the contact component 30 of the male connector 100, and a second end, or portion, may be inserted into the second receptive contact opening 227 of the female connector 200 to extend a continuous electrical path through the connector 200. Moreover, a third contact 130 may extend a continuous electrical path through the connector 100. In one embodiment, a first end, or portion, of the third contact 130 may be inserted through the third contact opening 35 of the contact component 30 of the male connector 100, and a second end, or portion, may be inserted into the third receptive contact opening 228 of the female connector 200 extend a continuous electrical path through the connector 200.

Referring still to the drawings, FIGS. 3A-4 depict an embodiment of a multi-conductor connection pair 5, in particular, an embodiment of a male multi-conductor cable connector 100 and a female multi-conductor cable connector 200 in a partially mated position. Prior to and/or while in a partially mated position, the female multi-conductor cable connector 200 enters the internal pathway or generally axial opening of the male multi-conductor cable connector 100, and the threaded insert 170 may reside contiguous, abut, and/or physically contact the elastomer ring 140. In this position, (i.e. prior to mating or partially mated) the integral key 150 of the outer housing 190 is positioned within the slot 175 of the threaded insert 170. In one embodiment, the integral key 150 is positioned between the ends of the substantially annular threaded insert 170, wherein the ends of the annular threaded insert 170 are separated by a space defined by the width of slot 175 of the threaded insert 170. In addition, the second end 292 of the female outer housing 290 has yet to physically contact or reside proximate or otherwise near the contact plate 188, but is disposed within, or axially inserted, some distance within the male outer housing 190. Furthermore, in the partially mated position, the external threads 273 of the female outer housing 290 have not yet engaged the threaded insert 170. Thus, in a partially mated position, the female connector 200 is not securably joined with the male connector 100.

Figure 6:
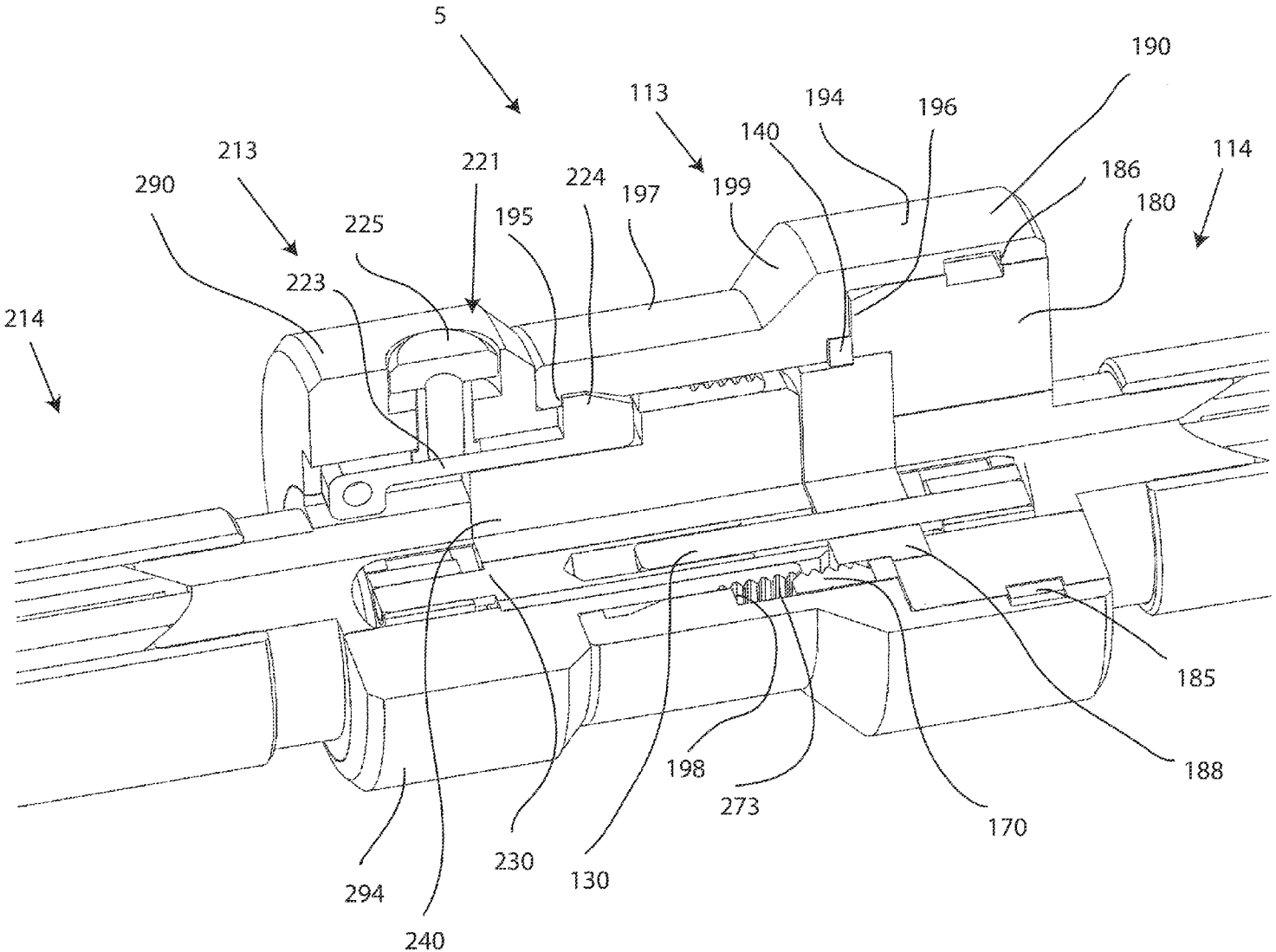
FIG. 6 depicts a partially cut-away perspective view of an embodiment of the female multi-conductor cable connector and an embodiment of a male multi-conductor cable connector, in a fully mated position.

FIG. 6 depicts an embodiment of a multi-conductor connection pair 5, in particular, an embodiment a female multi-conductor cable connector 200 and a male multi-conductor cable connector 100 in a fully mated position. When in a fully mated position, the second end 292 of the female outer housing 290 may physically contact or reside proximate the contact plate 188 of the male outer housing 190. Furthermore, in a fully mated position, the threaded insert 170 can be pressed between the elastomer ring 140 and the second end 292 of the female housing 290. In some embodiments, the elastomer ring 140 may be slightly compressed when the connectors 100, 200 are in the fully mated position so that the threaded insert 170 does not prevent a corresponding female multi-conductor cable connector, which does not have external threads 273, from achieving a fully mated (not secured) position with a male multi-conductor connectors, such as connector 100 (i.e. elastomer ring 140 may help ensure compatibility). Also, the threaded insert 170 may initially engage the threads 273 of the female outer housing 290 without any advancement, axially or otherwise, of the threaded insert 170 onto the external threads 273. The fully mated position may be achieved by axially inserting the male multi-conductor cable connector 100 into the female multi-conductor cable connector 200, or vice versa. Moreover, while in the fully mated position, the securing means 221 of the female multi-conductor cable connector 200, in particular, the latch head 224 may engage the recessed edge 195 of the male outer housing 190 to provide a releasable securing means. The securing means 221, in particular, the engagement of the latch head 224 and the recessed edge 195 may provide a preliminary, releasable securing means in an attempt to prevent unwanted disengagement between the male and female multi-conductor cable connector 100, 200 in the fully mated, not secured, position. However, the securing means 221, which may be similar to standard latch mechanisms known to those having skill in the art, can easily be unintentionally disengaged by accidental contact with the lock button 225 or any portion of the connector which may jostle the latch head 224 from the recessed edge 195 of the male housing. Furthermore, variety in the design and dimensions of the latch arms/mechanisms from different manufacturers lead to insufficient or incompatible contact/engagement with connectors designed and assembled by different manufacturers. Thus, in the fully mated position, the female multi-conductor cable connector 200 and the male multi-conductor cable connector 100 are not yet securably joined together Moreover, while in the fully mated position, a plurality of continuous electrical paths through the connectors 100, 200 may be established between the connection pair 5. Thus, the connection pair 5 (connectors 100, 200) may still be operable in the fully mated position, but the risks of unwanted disengagement still exist. For example, in the fully mated position, the male multi-conductor cable connector 100 may be in electrical communication with the female multi-conductor cable connector 200. The plurality of aligned electrical contacts 110, 120, 130 of connector engagement portion 113, when in the fully mated position, may likely electrically contact the corresponding contacts 210, 220, 230 of connector engagement portion 213. However, when in the fully mated position, the connector pair 5 (connectors 100, 200) may be separated with only axial movement and/or dislodgement of the securing means 221, which may easily occur accidentally or unintentionally.

Figure 7:
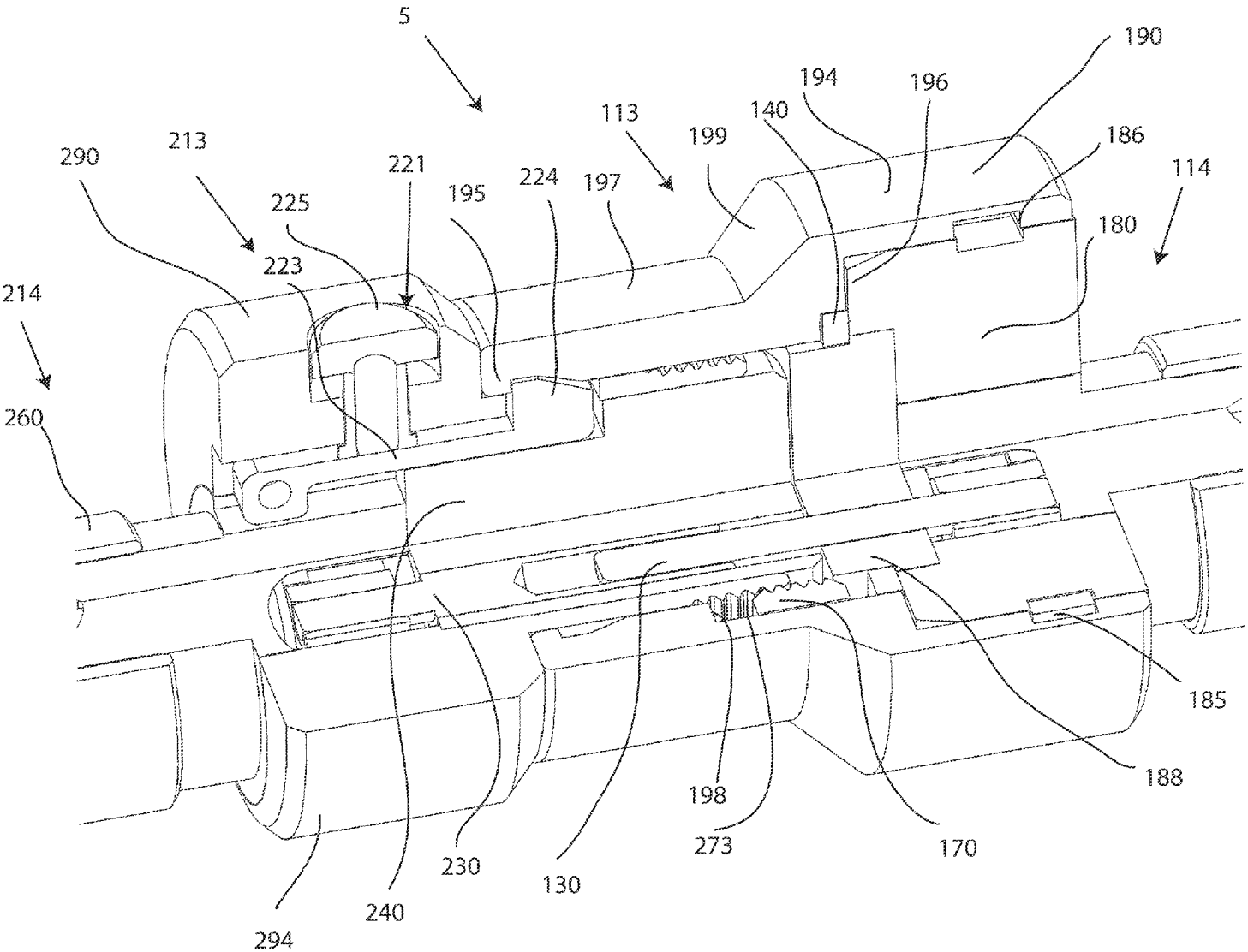
FIG. 7 depicts a partially cut-away perspective view of an embodiment of the female multi-conductor cable connector and an embodiment of a male multi-conductor cable connector, in a partially securably joined position.

Referring now to FIG. 7, the manner in which an embodiment of a multi-conductor connection pair 5, in particular, an embodiment of a male multi-conductor cable connector 100 securably joined with an embodiment of a female multi-conductor cable connector 200 is now described. Once the connectors 100, 200 are fully mated, as depicted in FIG. 6, the male outer housing 190 may be rotated to securably join the connectors 100, 200. Specifically, rotating the male outer housing 190 threadably engages the threaded insert 170 with the external threads 273 of the female housing 290. In other words, rotational movement of the male outer housing 190 advances the threaded insert 170 onto the external threads 273 of the female outer housing to securably join the corresponding connectors 100, 200, preventing unwanted or unintentional disengagement. The rotation of the rotatable outer housing 190 causes the threaded insert 170 to rotate along with the outer housing 190 because of the interaction between the integral key 150 of the outer housing 190 and the threaded insert 170. For example, the key 150 fits in the slot 175 of the threaded insert 170 and exerts a directional force against the threaded insert 170 to cause movement of the threaded insert 170; the key 150 integrally rotates/moves with the outer housing 190. In other words, the integral key 150 in the male outer housing 190 and the slot 175 in the threaded insert 170 provides the torque transmission between those two components, while permitting relative axial movement. In another embodiment, the rotation of the outer housing 190 for example, in a clockwise or counter-clockwise direction, affords work onto the threaded insert 170 to rotate the threaded insert 170. As the threaded insert 170 begins to rotate, the threads 173 of the threaded insert 170 may engage the external threads 273 of the female outer housing 290. Continued rotation of the male outer housing 190 in the same direction should cause further engagement between the threaded insert 170 and the female outer housing 290, and axial displacement of the threaded insert 170 from a position proximate, touching, or otherwise near the elastomer ring 140 towards the internal stop 98, 198 of the male outer housing. FIG. 7 shows an embodiment of the threaded insert 170 in a position after a few revolutions of the male outer housing 190, wherein the key feature 150 has driven the threaded insert 170 into engagement with the external threads 273 of the female outer housing 290, also axially displacing the threaded insert 170 a distance away from the elastomer ring 140. Even in this partially securably joined position, the threaded pair of the threaded insert 170 and the threaded female outer housing 290 are unlikely to separate enough to disengage electrically. It is contemplated that the female outer housing 290 may also be rotatable, and may include an inner body, similar to inner body 180 utilizing a snap ring; however, if the female outer housing is rotatable, the securing means 221, including the latch arm 223 and latch head 224 may have to removed.

Figure 8:
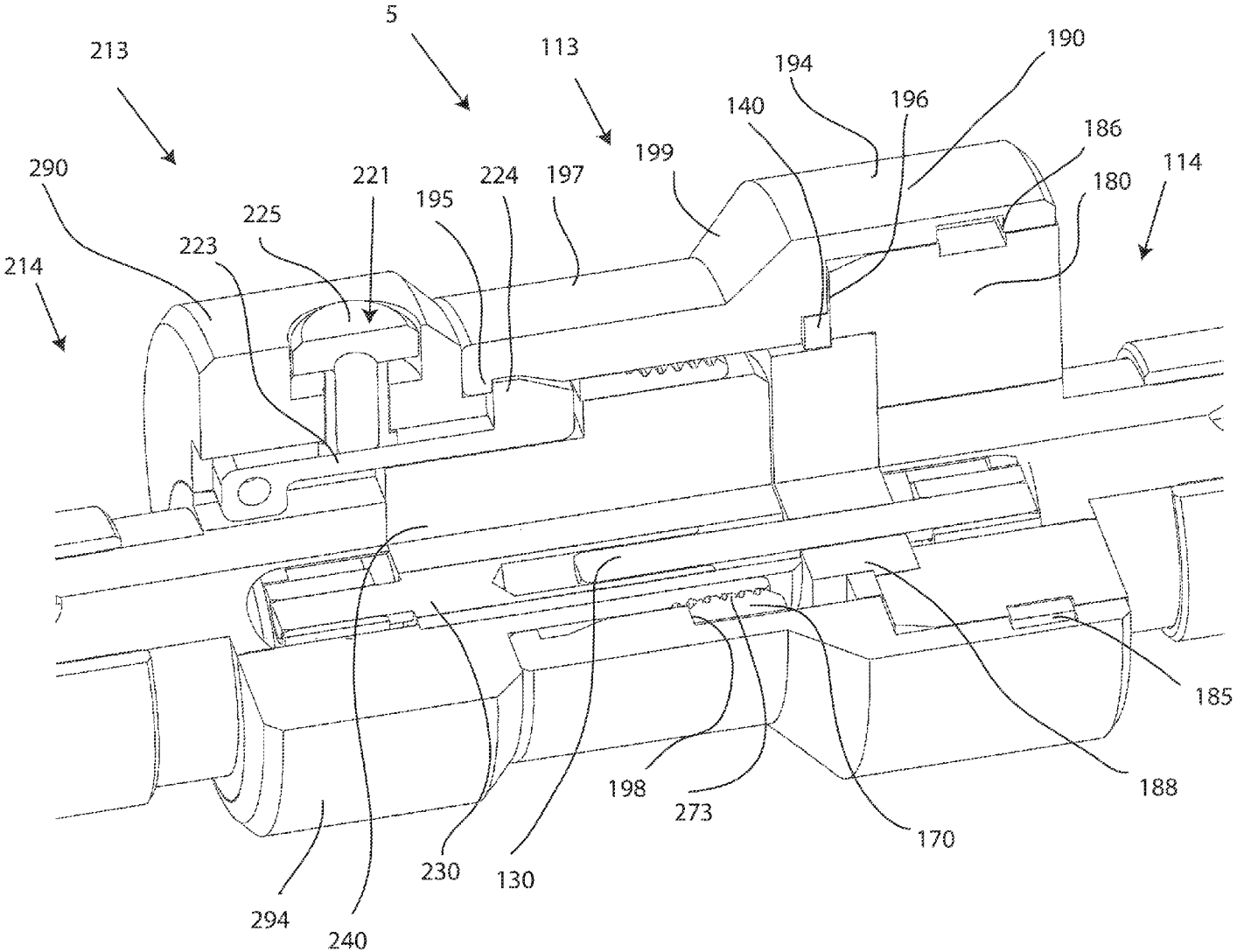
FIG. 8 depicts a partially cut-away perspective view of an embodiment of the female multi-conductor cable connector and an embodiment of a male multi-conductor cable connector, in a fully securably joined position.

With reference now to FIG. 8, an embodiment of a male multi-conductor cable connector 100 in a fully securably joined position is now described. Continued rotation of the male outer housing 190 may cause the integral key 150 to continue driving the threaded insert 170 until the threads 173 of the threaded insert 170 and the external threads 273 of the female housing 290 completely interlock and are thoroughly threadably engaged. The threads 173 of the threaded insert 170 and the external threads 273 of the female housing 290 are completely interlocked and thoroughly threadably engaged when the threaded insert 170 has axially displaced from proximate the elastomer ring 140 to the internal stop 98, 198, which may hinder further movement, axial or partial rotational movement. Similarly, once the threaded insert 170 has reached (i.e. physically presses against) the internal stop 98, 198 of the outer housing 190, further rotational movement of the outer housing 190 in the direction consistent with displacing the threaded insert 170 toward the internal stop 98, 198 may be prevented and/or hindered. Thus, a user may detect when the connectors 100, 200 are in a fully secured position because it will become increasingly difficult to rotate the male outer housing 190 any further. At this point, the male multi-conductor cable connector 100 cannot be separated from the female multi-conductor cable connector 200 without unscrewing or rotating the outer housing 190 in a direction opposing the direction turned to lock/secure the connectors 100, 200, or connection pair 5.

To separate the male multi-conductor cable connector 100 from the female multi-conductor cable connector 200, when in a fully securably joined position, the outer housing 190 must be rotated in a direction opposing or counter to the direction the outer housing 190 was turned to advance the threaded insert 170 onto the external threads 273 of the female outer housing 290. While the male outer housing 190 is rotated in the reverse direction, the threaded insert 170 will rotatably and axially withdraw from the threads 273 and axially displace toward the elastomer ring 140. Once the threaded insert 170 has been axially displaced away from the internal stop 98, 198 to the elastomer ring 140, through counter-rotation of the male outer housing 190, the male multi-conductor cable connector 100 can be separated from the female multi-conductor cable connector 200 without the need to unscrew and/or rotate the outer housings 190, 290. In other words, the connectors 100, 200 return to the fully mated position, wherein separation can be achieved without the need to twist the outer housings 190, 290, (i.e. axial movement alone).

Figure 9:
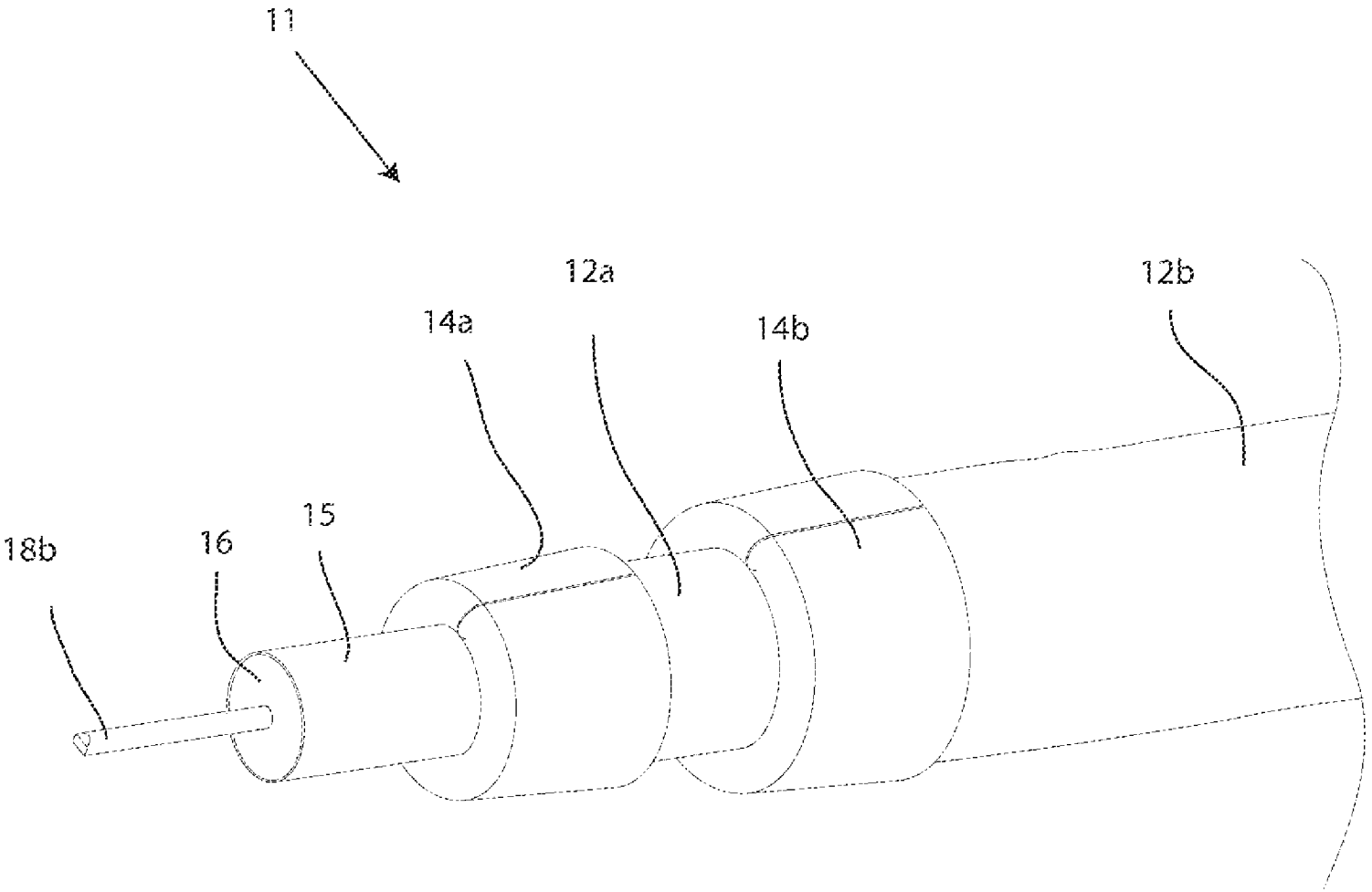
FIG. 9 depicts a perspective view of a second embodiment of a multi-conductor cable having a plurality of conductive strands concentrically sharing a common central axis.

With reference to FIG. 9, connectors 100, 200 may be configured to receive a first embodiment of a multi-conductor cable, such as multi-conductor cable 10, or receive a second embodiment of a multi-conductor cable, such as multi-conductor cable 11. The multi-conductor cable 11 may include a center conductive strand 18*b*, surrounded by an interior dielectric 16; the interior dielectric 16 may possibly be surrounded by a conductive foil layer 15; the interior dielectric 16 (and the possible conductive foil layer 15) is surrounded by a first conductive strand layer 14*a*; the first conductive strand layer 14*a* is surrounded by a first protective outer jacket 12*a*, wherein the first protective outer jacket 12*a* has dielectric properties and serves as an insulator; the first protective outer jacket 12*a* is surrounded by a second conductive strand layer 14*b*; and, the second conductive strand layer 14*b* is surrounded by a second protective outer jacket 12*b*. Thus, multi-conductor cable 11 may share the same structure and features of multi-conductor cable 10, except that multi-conductor cable 11 may have a center conductive strand 18*b* which protrudes from the dielectric 16. For instance, the center conductive strand 18*b* may protrude and/or extend from the dielectric 16 and enter a socket of a female type electrical contact. The multi-conductor cable 11 may be prepared similar to the multi-conductor cable 10, with further preparation of the multi-conductor cable 11 including stripping the dielectric 16 (and potentially conductive foil layer 15) to expose a portion of the center conductive strand 18*b*.

Referring now to FIGS. 1-9, an embodiment of a method of securing a multi-conductor cable connection pair 5 is now described. One embodiment of the method may include the steps of providing a first multi-conductor cable connector 100 having a first cable connection portion 114 coupled to a first connector engagement portion 113, wherein the first cable engagement portion 113 includes a rotatable outer housing 190 and a threaded insert 170 disposed within the rotatable outer housing 190, and a second multi-conductor cable connector 200 having a second cable connection portion 214 coupled to a second connector engagement portion 213, wherein the second connector engagement portion 213 includes a threaded outer housing 290 configured to engage the threaded insert 170 of the first connector engagement portion 113, and advancing the threaded insert 170 onto the threaded outer housing 290 through rotational movement of the rotatable outer housing 190. In most embodiments, the first multi-conductor cable connector 100 is a male multi-conductor cable connector, and the second multi-conductor cable connector 200 is a female multi-conductor cable connector. Moreover, the rotatable housing 190 may be integrally connected to the threaded insert 170, such that rotation of the rotatable outer housing 190 may afford work onto the threaded insert 170.

Furthermore, an embodiment of a method of securing a multi-conductor cable connector 100 to a corresponding multi-conductor cable connector 200 is now described. One embodiment of the method may include the steps of providing a connector engagement portion 113 including: a rotatable outer housing 190, a threaded insert radially 170 disposed within the outer housing 190, and a plurality of electrical contacts 110, 120, 130, wherein rotating the outer housing 190 axially advances the threaded insert 170 to securably engage the corresponding multi-conductor cable connector 200.

Embodiments of a multi-conductor cable connection pair 5, connector 100 and connector 200 may be operable with a compression type engagement with a coaxial cable, a soldered multi-conductor cable connection, overmolded connection to multi-conductor bundled wire, or any other cable connection embodiments known to those having ordinary skill in the art.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A multi-conductor cable connector comprising:

a connector engagement portion including:

an outer housing having a first end a second end, wherein the outer housing includes external threads proximate the second end;

a securing means including a latch arm and a latch head attached to an end of the latch arm, the securing means being releasable with a lock button; and a plurality of electrical contacts;

wherein the external threads of the outer housing are configured to mate with threads of a threaded insert disposed within a corresponding multi-conductor cable connector to securably engage the corresponding multi-conductor cable connector after achieving a fully mated position upon full axial insertion into the corresponding multi-conductor cable connector.

2. The multi-conductor cable connector of claim 1, wherein the outer housing rotates axially independent of the corresponding multi-conductor cable connector while in a fully mated position with the multi-conductor cable connector.

3. The multi-conductor cable connector of claim 1, wherein rotational movement of the outer housing translates to axial movement of the threaded insert securably engaging the corresponding multi-conductor cable connector.

4. The multi-conductor cable connector of claim 1, wherein the corresponding multi-conductor cable connector is a female connector.

5. The multi-conductor cable connector of claim 1, wherein the plurality of electrical contacts are hermaphroditic.

6. The multi-conductor cable connector of claim 1, wherein the threaded insert is radially disposed within the outer housing, the threaded insert having a slot therethrough.

7. The multi-conductor cable connector of claim 6, further including a key feature integral with the outer housing, the key feature configured to fit within the slot of the threaded insert.

8. The multi-conductor cable connector of claim 1, wherein the connector engagement portion is coupled to a cable connection portion.

9. The multi-conductor cable connector of claim 8, wherein the cable connection portion is a compression connector.

10. The multi-conductor cable connector of claim 8, wherein the cable connection portion is a soldered connection.

11. A method of securing a first multi-conductor cable connector to a second multi-conductor cable connector, comprising:

inserting a first multi-conductor cable connector having a connector engagement portion including:

an outer housing having a first end a second end, wherein the outer housing includes external threads proximate the second end;

a securing means including a latch arm and a latch head attached to an end of the latch arm, the securing means being releasable with a lock button; and a plurality of electrical contacts, into a second multi-conductor cable connector to engage the securing means;

rotating the outer housing axially to engage a threaded insert disposed within the second multi-conductor cable connector; and sliding the threaded insert toward the first multi-conductor cable connector, wherein the threaded engagement of the outer housing to the threaded insert resists axial separation of first multi-conductor cable connector from the second multi-conductor cable connector.

12. The method of claim 11, wherein the threaded insert is radially disposed within the outer housing, the threaded insert having a slot therethrough; and wherein the outer housing further includes an integral key feature, the key feature configured to fit within the slot of the threaded insert.

13. The method of claim 12, wherein the step of sliding further includes the threaded insert moving axially along the key feature of the outer housing.

14. The method of claim 11, further including the step of tightening the threaded insert against an internal stop in the outer housing.

* * * * *